US008127711B2

(12) United States Patent
Ganzer et al.

(10) Patent No.: US 8,127,711 B2
(45) Date of Patent: Mar. 6, 2012

(54) MOUNTING SYSTEMS FOR AN ADHESIVE APPLICATION SYSTEM AND METHODS FOR APPLYING ADHESIVE

(75) Inventors: Charles P. Ganzer, Cumming, GA (US); Scott D. Walker, Roswell, GA (US)

(73) Assignee: Nordson Corporation, Westlake, OH (US)

( * ) Notice: Subject to any disclaimer, the term of this patent is extended or adjusted under 35 U.S.C. 154(b) by 877 days.

(21) Appl. No.: 12/167,515

(22) Filed: Jul. 3, 2008

(65) Prior Publication Data

US 2009/0007845 A1 Jan. 8, 2009

Related U.S. Application Data

(60) Provisional application No. 60/948,045, filed on Jul. 5, 2007.

(51) Int. Cl.
*B05C 3/02* (2006.01)
*B05B 3/00* (2006.01)
*B05B 13/02* (2006.01)

(52) U.S. Cl. ..... 118/410; 118/419; 118/323; 118/325

(58) Field of Classification Search ..... 118/410, 118/411, 300, 321, 323, 421, 307, 325, 419; 239/128, 133, 134, 135, 550, 551, 267, 268; 156/212, 304.1, 196, 486, 350, 574, 575, 156/356, 357, 361, 362, 363, 538, 546, 547, 156/551, 578

See application file for complete search history.

(56) References Cited

U.S. PATENT DOCUMENTS

| | | | | |
|---|---|---|---|---|
| 490,146 | A | | 1/1893 | James |
| 2,641,871 | A | | 6/1953 | Ray |
| 2,796,847 | A | | 6/1957 | Guggenheim |
| 2,993,488 | A | | 7/1961 | Stec |
| 3,170,483 | A | | 2/1965 | Milroy |
| 3,312,241 | A | | 4/1967 | Bryant |
| 3,459,336 | A | | 8/1969 | Ruud |
| 3,665,890 | A | * | 5/1972 | Mishler ..... 118/412 |
| 4,535,719 | A | * | 8/1985 | Regan ..... 118/410 |
| 4,550,681 | A | | 11/1985 | Zimmer |
| 4,565,217 | A | | 1/1986 | McIntyre |
| 4,922,852 | A | | 5/1990 | Price |

(Continued)

FOREIGN PATENT DOCUMENTS

DE 7704627 A 7/1977

(Continued)

OTHER PUBLICATIONS

European Patent Office, International Search Report and Written Opinion in Corresponding PCT Application Serial No. PCT/US2006/005619 dated Aug. 7, 2006.

(Continued)

*Primary Examiner* — Yewebdar Tadesse

(74) *Attorney, Agent, or Firm* — Wood, Herron & Evans, LLP

(57) ABSTRACT

An apparatus for use with an adhesive dispenser configured to apply an adhesive to an edge of a moving substrate. The mounting system includes a support post and a main body. The main body is configured to support the adhesive dispenser and is coupled to the support post, with the main body being configured to deflect the adhesive dispenser in a first direction and in a second direction transverse to the first direction upon contact of the substrate with the adhesive dispenser.

16 Claims, 17 Drawing Sheets

U.S. PATENT DOCUMENTS

| | | | | |
|---|---|---|---|---|
| 5,129,772 | A | 7/1992 | Slautterback | |
| 5,271,794 | A | 12/1993 | Jarrell | |
| 5,370,319 | A | 12/1994 | Schlegel | |
| 6,467,522 | B1 * | 10/2002 | Durney et al. | 156/355 |
| 6,689,214 | B2 | 2/2004 | Burmester | |
| 6,695,031 | B1 | 2/2004 | Baltensperger | |
| 6,802,904 | B2 | 10/2004 | Pedigrew | |
| 2006/0213434 | A1 | 9/2006 | Ganzer et al. | |

FOREIGN PATENT DOCUMENTS

| | | | |
|---|---|---|---|
| DE | 3234963 | A1 | 3/1984 |
| DE | 20303182 | U1 | 7/2003 |
| EP | 0453936 | A2 | 10/1991 |
| GB | 447219 | A | 5/1936 |
| GB | 1503511 | A | 3/1978 |

OTHER PUBLICATIONS

Office Action; dated as mailed on Jun. 11, 2008 for U.S. Appl. No. 11/263,485; 10 pages; U.S. Patent and Trademark Office.

Valco Cincinnati, "Edgebanding Application System", product brochure, Nov. 2006 (2 pages).

* cited by examiner

MOUNTING SYSTEMS FOR AN ADHESIVE APPLICATION SYSTEM AND METHODS FOR APPLYING ADHESIVE

CROSS-REFERENCE TO RELATED APPLICATIONS

This application claims the benefit of U.S. Provisional Patent Application Ser. No. 60/948,045 filed Jul. 5, 2007, the disclosure of which is incorporated by reference herein in its entirety.

TECHNICAL FIELD

The present invention generally relates to adhesive application systems and, more particularly, to mounting brackets for systems that apply adhesive to an edge of a substrate moving relative to an adhesive dispenser of the system and methods for applying adhesive.

BACKGROUND

Systems are known that are used in the furniture industry today to apply adhesive two-dimensionally to furniture parts, including, for example, two dimensional panels. Known systems may utilize an open glue pot and roller to apply adhesive via direct contact between the roller and the panel moving past the roller.

In order to resolve problems associated with open glue pot systems, "closed" systems employing a "hot melt unit" have been developed that melt the adhesive material and pump it through a heated hose at high pressure to a gun or dispensing head. The dispensing head is typically mounted on a frame, and the panel material is conveyed past the applicator head by a transport device. During operation, the adhesive is discharged through an elongated slot of a slot nozzle assembly and is dispensed onto the surface of the substrate being conveyed past the slot. The slot is usually oriented transverse to the direction of the relative motion between the dispensing head and the substrate.

Other systems may include adhesive applicators that have grooves or ridges which aid in the distribution of adhesive on the substrate. The grooves are directed generally along the direction of travel of the substrate and included an output therein in communication with the grooves.

None of the known systems, however, is suitably designed to cope with warped panels. This may result in the substrate moving relative to an adhesive dispenser and adhesive being applied beyond its intended target. Moreover, known systems may not permit the application of a consistent pattern along the entire length of the substrate. More particularly, known systems result in the substrate moving away from a discharge of the dispenser as a trailing portion of the substrate moves past the dispenser.

SUMMARY

In one embodiment, an apparatus is provided for use with an adhesive dispenser for applying adhesive to an edge of a moving substrate. The apparatus includes a support post and a main body. The main body is configured to support the adhesive dispenser and is coupled to the support post, with the main body being configured to deflect the adhesive dispenser in first and second directions that are transverse to one another upon contact of the substrate with the adhesive dispenser.

The main body may be positioned to deflect the adhesive dispenser in a generally horizontal plane and in a generally vertical plane upon contact of the substrate with the adhesive dispenser. The apparatus may include at least one biasing member operatively coupled to the support post for urging the adhesive dispenser toward the substrate. The at least one biasing member may be positioned to oppose movement of the adhesive dispenser in the first or second directions. The at least one biasing member may, for example, be a compression spring. The apparatus may include a plate configured for coupling with the adhesive dispenser and positioned to cooperate with the main body to move the edge of the substrate into alignment with an output of the adhesive dispenser. The main body may have a first end coupled to the support post and a second end for coupling with the adhesive dispenser, with the main body being configured to support the adhesive dispenser in cantilever fashion.

The apparatus may include a first roller that is configured to support the substrate and is positioned downstream of an output of the adhesive dispenser along a direction of travel of the substrate. The roller may be coupled to the adhesive dispenser. A second roller may be configured to support the substrate and be positioned upstream of the output of the adhesive dispenser along a direction of travel of the substrate. The apparatus may include a plurality of rollers coupled to the main body and rotatable along the support post for providing vertical movement of the main body relative to the support post. The apparatus may include a base coupling the support post to a frame of reference, with the main body being configured to permit rotational movement of the adhesive dispenser relative to the base.

In another embodiment, an apparatus is provided for use with an adhesive dispenser for applying adhesive to an edge of a moving substrate. The apparatus includes a support post and a main body that is configured to support the adhesive dispenser. The main body is coupled to the support post and is configured to move the adhesive dispenser in a generally horizontal plane and in a generally vertical plane upon contact of the substrate with the adhesive dispenser. The apparatus includes a pair of biasing members coupled to the main body for opposing respective movement of the adhesive dispenser in the horizontal and vertical planes. A roller is positioned downstream of an output of the adhesive dispenser along a direction of travel of the substrate and is configured to support the substrate.

In yet another embodiment, an edge banding system is provided for applying adhesive onto an edge of a moving substrate. The system includes an adhesive dispenser that has an output surface adapted to dispense the adhesive onto the substrate, and a mounting system coupled to the adhesive dispenser. The mounting system has a support post and a main body for supporting the adhesive dispenser and is coupled to the support post. The main body is configured to deflect the adhesive dispenser in first and second directions transverse to one another upon contact of the substrate with the adhesive dispenser. The output surface may be adjustable to define a dimension of the adhesive applied onto the substrate. The output surface may include a plurality of grooves defining beads of the adhesive applied onto the substrate.

In another embodiment, a method is provided for applying adhesive to an edge of a substrate. The method includes contacting an adhesive dispenser with the substrate and, in response to the contact, permitting the adhesive dispenser to move in a first direction. In response to the contact, the adhesive dispenser is permitted to move in a second direction that is transverse to the first direction. The method may include spring biasing the adhesive dispenser toward the substrate. The adhesive dispenser may be moved in a generally horizontal plane and in a generally vertical plane.

DETAILED DESCRIPTION

Figure 1:
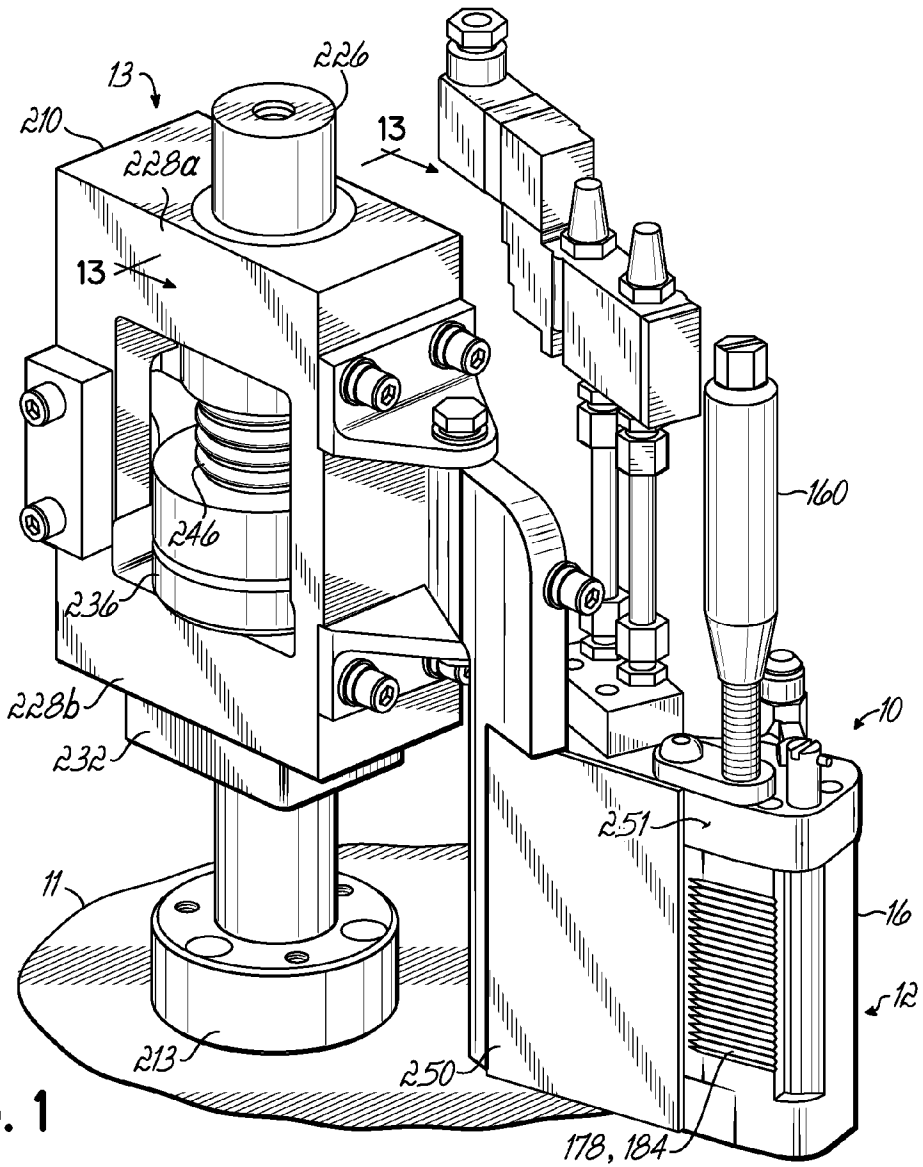
FIG. 1 is a perspective view of a portion of an edge banding system.
Figure 1A:
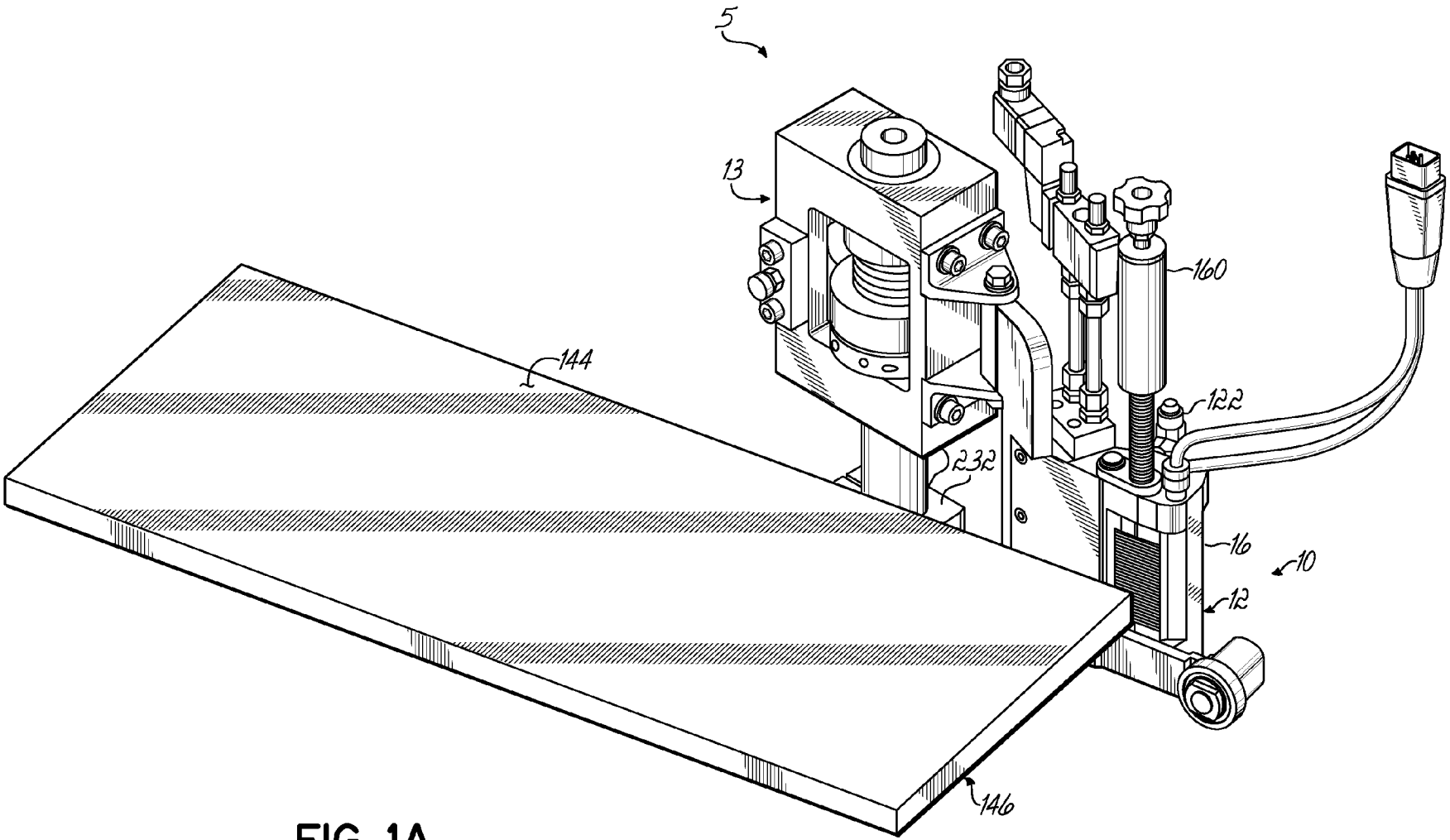
FIG. 1A is a perspective view of the system of FIG. 1 dispensing adhesive onto a substrate.
Figure 2:
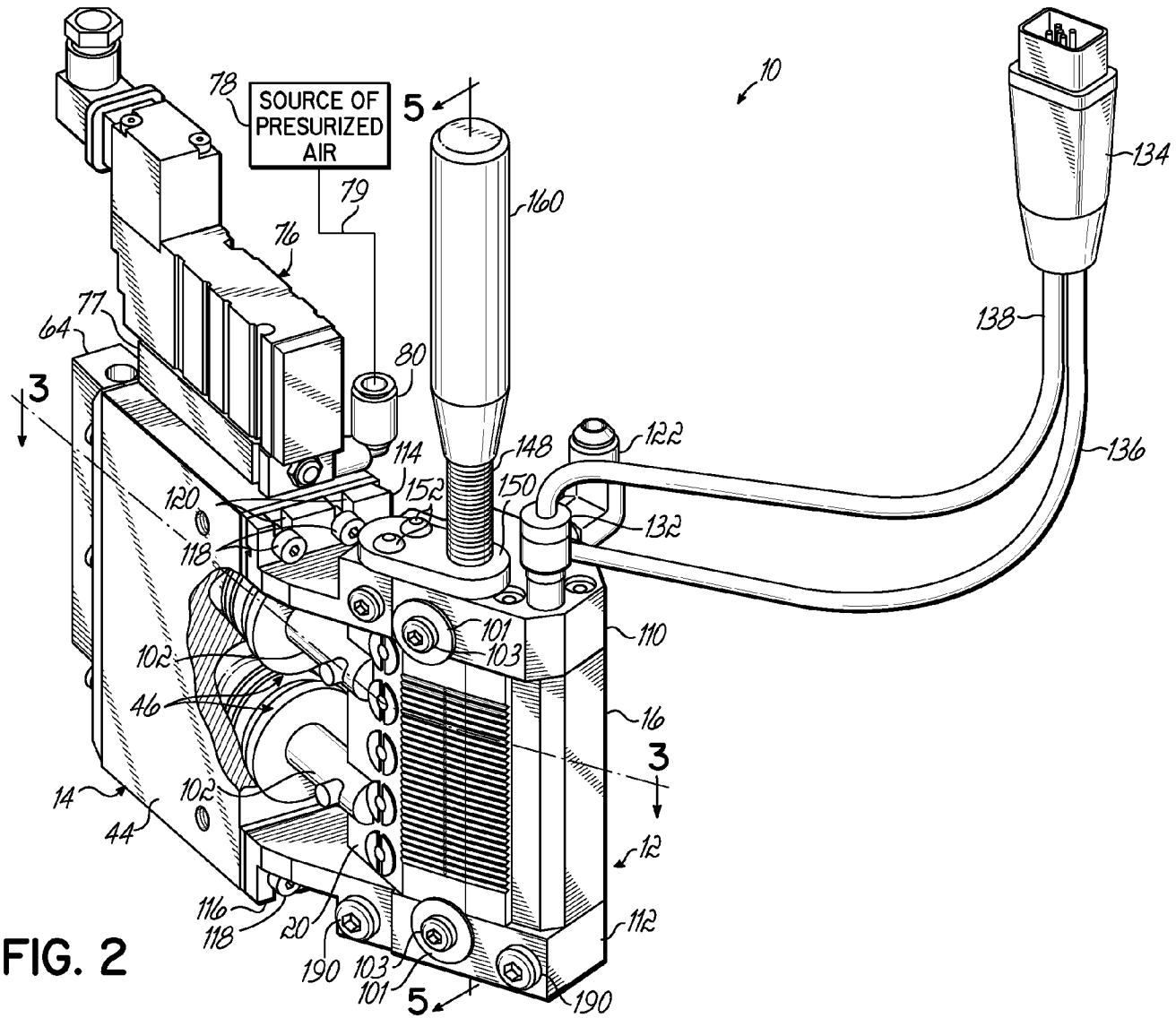
FIG. 2 is a perspective view of an adhesive dispenser of the system of FIG. 1.

With reference to the figures and, more particularly, to FIGS. 1, 1A, and 2, an edge banding system 5 includes an adhesive dispenser 10 coupled to a frame 11 via a mounting bracket 13. Edge banding system 5 is configured to dispense adhesive onto an edge of a work piece or substrate 146. Dispenser 10 can be adjusted to dispense adhesive patterns of varying width as subsequently discussed. Dispenser 10 includes a valve 12 and an actuator assembly 14 (FIG. 2) that are coupled to one another as discussed in further detail below. Dispenser 10 is described in U.S. application Ser. No. 11/263,485 which published as U.S. Publication No. 2006-0213434 A1, the disclosure of which is hereby incorporated by reference herein in its entirety.

Figure 4A:
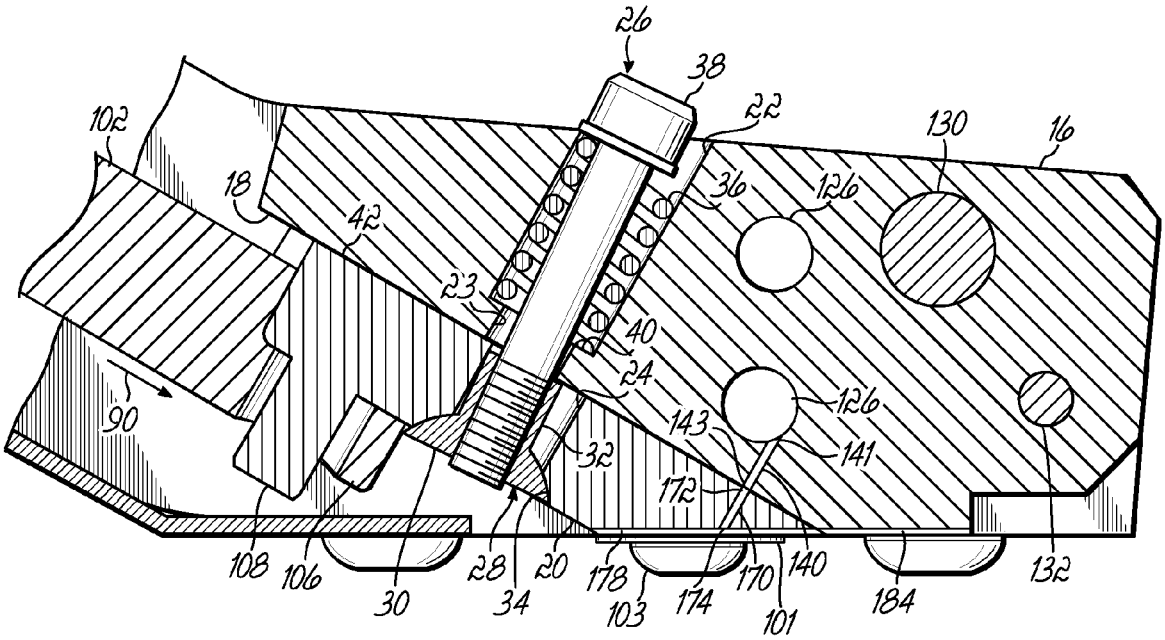
FIG. 4A is an enlarged, fragmentary view of the adhesive dispenser shown in FIG. 3, with an included valve block in an open position.
Figure 4B:
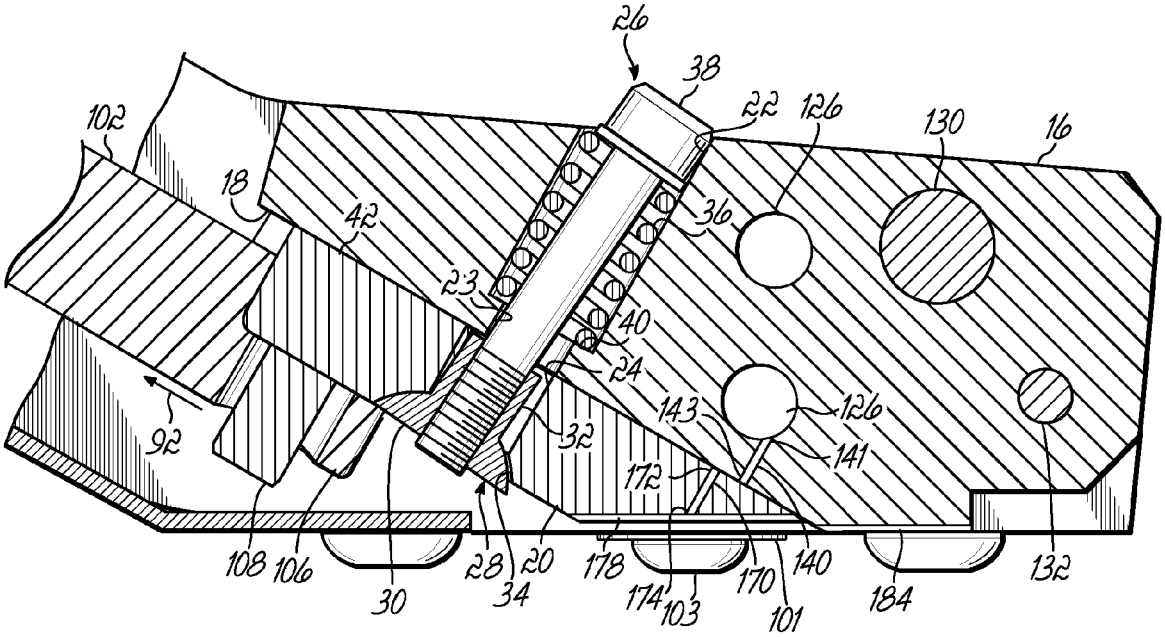
FIG. 4B is an enlarged, fragmentary view similar to FIG. 4A, with the valve block in a closed position.
Figure 5:
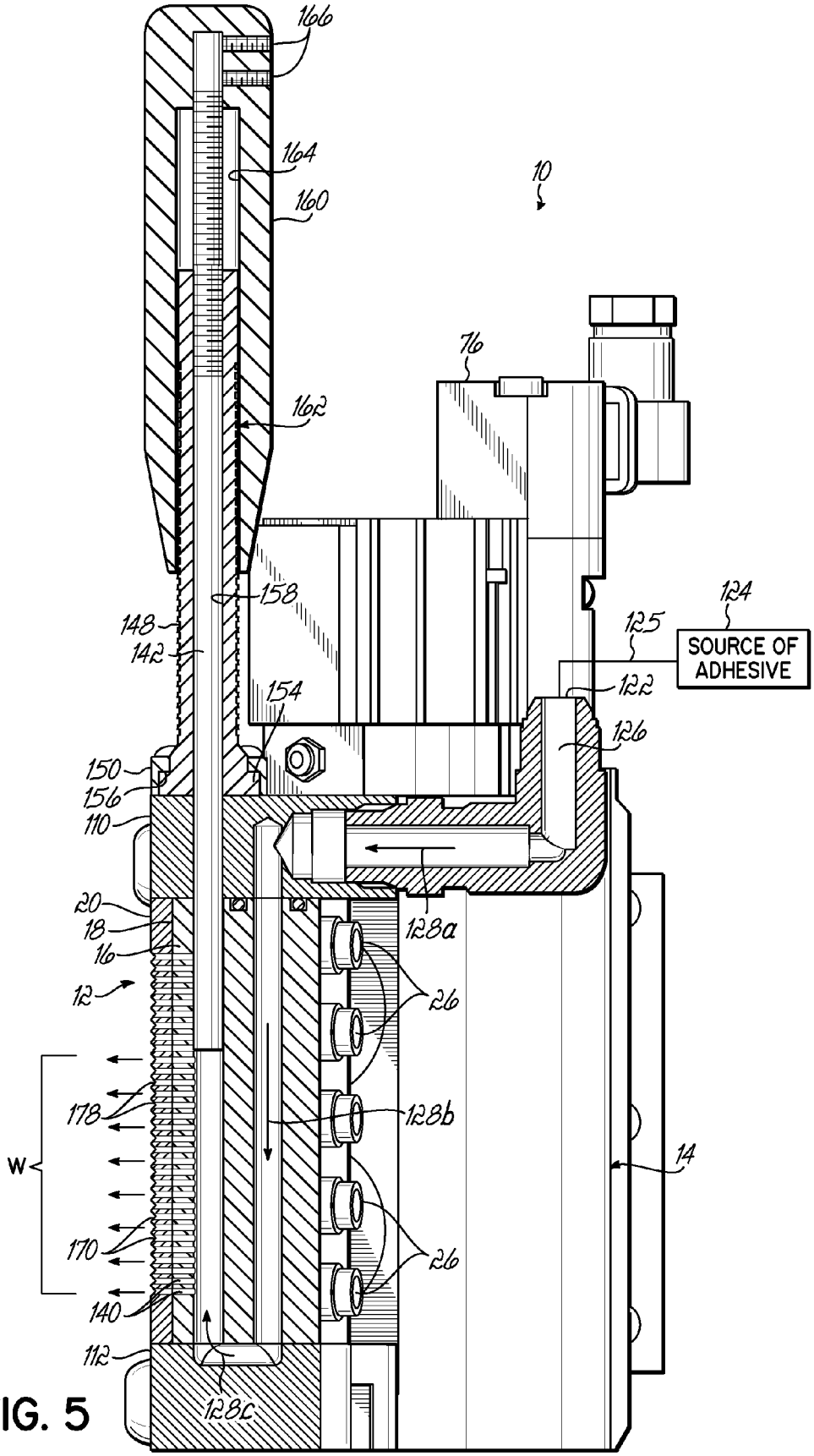
FIG. 5 is a cross-sectional view taken along the lines 5-5 in FIG. 2.

With continued reference to FIGS. 1-1A and 2 and with further reference to FIGS. 4A-4B and 5, the valve 12 includes a valve body 16 having a first surface 18 and a valve block 20 that is mounted for sliding movement along surface 18 of valve body 16. Bores 22 are formed in valve body 16, each being spaced from one another. The valve body 16 also includes a second set of bores 23. Each of the bores 23 has a relatively smaller diameter than bores 22, with each bore 23 extending through surface 18 at one end and communicating with bores 22 at the opposite end. Bores 24 are formed in valve block 20, and are spaced from one another. Each of the bores 24 is generally aligned with one of the bores 22 to accommodate mounting elements as subsequently discussed. There are a like number of bores 22, 23 and 24, and, in the illustrative embodiment, there are five of each of bores 22, 23 and 24. However, it should be understood that other numbers of bores 22, 23 and 24, as well as the corresponding mounting elements, can be used to mount valve block 20 to valve body 16.

The mounting elements that are used to mount valve block 20 to valve body 16, while permitting sliding movement of valve block 20 relative to valve body 16, include a plurality of fasteners, such as bolts 26 and nuts 28. Nuts 28 include a substantially hemispherically-shaped head 30 and a shank portion 32 having internal threads. A plurality of counterbores 34 are formed in valve block 20 and each of the counterbores 34 is aligned with and communicate with one of the bores 24 formed in valve block 20. The head 30 of each nut 28 is disposed within one of the counterbores 34 and the heads 30 of nuts 28 cooperate with the counterbores 34 to allow the bolts 26 to pivot within bores 22, 23 and 24 as the valve block 20 slides between an open position shown in FIG. 4A, and a closed position shown in FIG. 4B.

The mounting elements further include a plurality of biasing elements disposed in one of the bores 22 formed in valve body 16. In the illustrative embodiment, the biasing elements are in the form of coil springs 36. Each coil spring 36 is disposed between a head 38 of one of the bolts 26 and a shoulder 40 formed in valve body 16 at the interface of bores 22 and 23. As bolts 26 are threaded into nuts 28, each spring 36 is compressed and exerts a force on the corresponding shoulder 40. The combined force exerted by coil springs 36 biases valve body 16 against valve block 20 along surface 18 of valve body 16 and a mating surface 42 of valve block 20. The magnitude of the force exerted by the coil springs 36 against shoulder 40 of valve body 16 is sufficient to force valve body 16 into contacting engagement with valve block 20 but small enough to permit valve block 20 to slide relative to valve body 16 when actuated.

Valve body 16 and valve block 20 can be made of hardened tool steel and can be manufactured such that surface 18 of valve body 16 and the mating surface 42 of valve block 20 each has a flatness, for example and without limitation, of about three lightbands (0.000030 inches) or less to provide a hydraulic seal between surfaces 18 and 42 when valve block 20 is in the closed position shown in FIG. 4B. Valve body 16 and valve block 20 can be made of other materials and surfaces 18 and 42 can have different flatness values provided valve block 20 can slide relative to valve body 16 and a hydraulic seal is provided between surfaces 18 and 42 when valve block 20 is in the closed position shown in FIG. 4B to prevent adhesive from leaking between surfaces 18 and 42 when valve block 20 is in the closed position.

Figure 3:
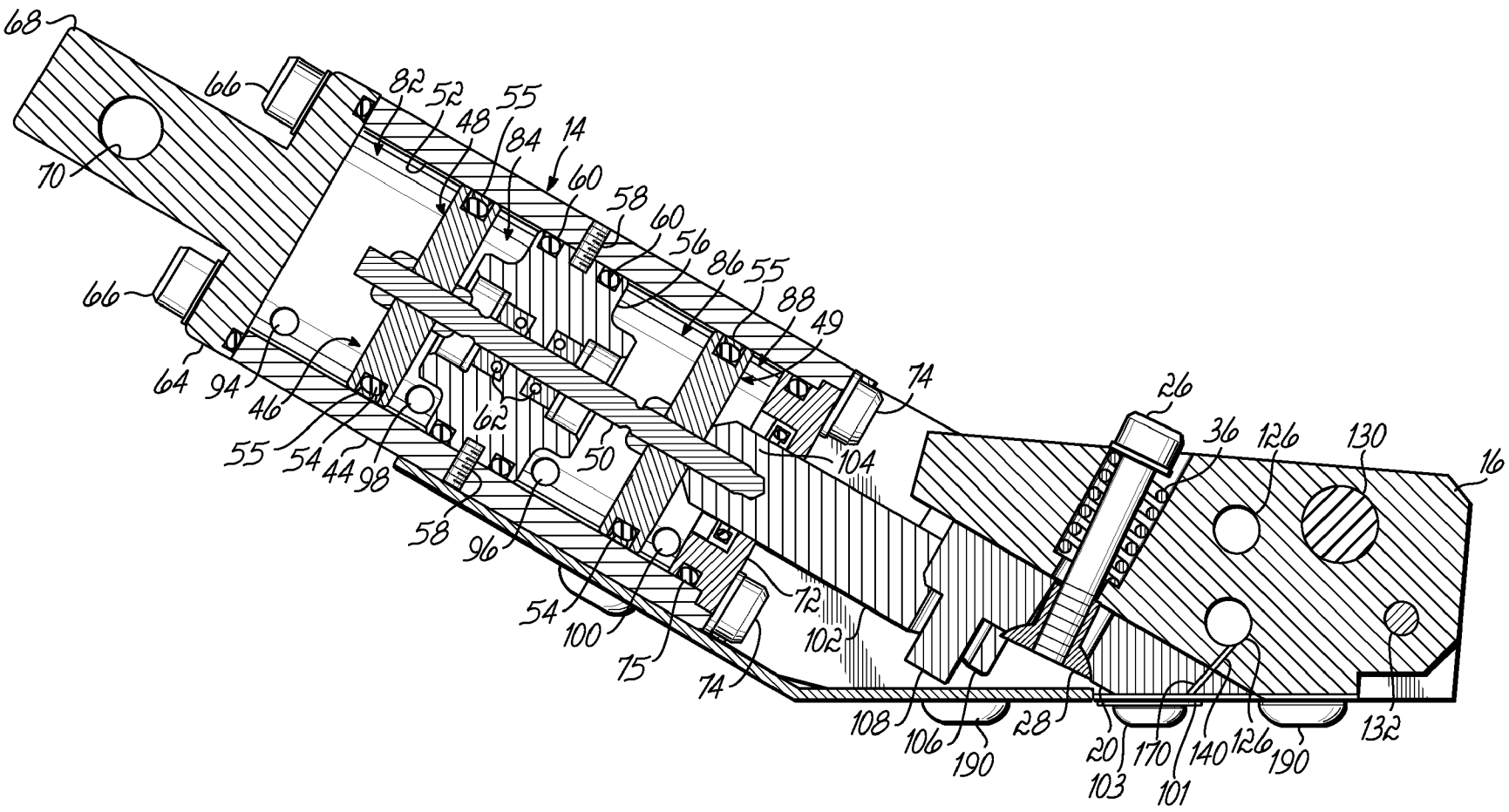
FIG. 3 is a cross-sectional view taken along line 3-3 of FIG. 2.

With particular reference to FIGS. 2 and 3, the actuator assembly 14 includes a body 44 and a pair of actuators 46 disposed within body 44, with one of the actuators being shown in detail in FIG. 3. The body 44 of actuator assembly 14 can be constructed of an aluminum block with individual, substantially cylindrical bores formed therein to accommodate the actuators 46. Other suitable constructions of body 44 can be alternatively utilized. In the illustrative embodiment, each actuator 46 includes two pistons 48, 49 that are secured by fasteners to a stem 50 that extends longitudinally within body 44 and is translatable within body 44. Pistons 48 and 49 are in slidable sealing engagement with an inner surface 52 of body 44 via resilient sealing members, such as O-rings 54, and piston glide rings 55. In the illustrative embodiment, two pistons 48, 49 are utilized to provide increased actuating force within the same space, as compared to an actuator having one piston. Alternatively, actuators having other numbers of pistons may be utilized. Additionally, other actuating devices may be used so long as a sufficient actuating force is provided to slide valve block 20 relative to valve body 16 between the open and closed positions.

Each actuator 46 further includes a stationary sealing plug 56 disposed within the body 44 of actuator assembly 14. Each plug 56 is retained within body 44 by a plurality of set screws 58 and is disposed in sealing engagement with the inner surface 52 of actuator body 44 via resilient sealing members 60 that can, for example, be O-rings. Seals 62 provide a seal between stem 50 and sealing plug 56.

The actuator assembly 14 further includes an end block 64 that is attached to body 44 by fasteners such as bolts 66. End block 64 includes a protruding portion 68 having one or more holes 70 formed therein which enables mounting of the actuator assembly 14 to the mounting bracket 13 (FIG. 1). A second end block 72 is secured to body 44 by fasteners such as bolts 74. End block 72 is sealed against the inner surface 52 of body 44 by a resilient member such as O-ring 75.

With continued ref. to FIGS. 2-3, the actuator assembly 14 includes a valve 76 that receives pressurized air from a source 78 of pressurized air. The pressurized air is supplied from source 78 via a conduit 79 to an inlet port 80 of valve 76. In the embodiment shown in FIGS. 2-9, valve 76 is an electrically operated, four-way solenoid valve and is mounted in close proximity to the actuator body 44. More particularly, valve 76 is mounted on a manifolding block 77 disposed on actuator body 44. In other embodiments, valve 76 may be alternatively spaced from manifolding block 77. In such a configuration, air supply tubes may extend between valve 76 and block 77 to provide air for the actuation of actuators 46.

Each of the actuators 46 includes cavities 82, 84, 86 and 88. As shown in FIG. 3, cavity 82 is disposed between end block 64 of actuator assembly 14 and a first side of piston 48 of actuator 46, while cavity 84 is disposed between an opposite side of piston 48 and sealing plug 56. Cavity 86 is disposed between sealing plug 56 and a first side of piston 49, while cavity 88 is disposed between an opposite side of piston 49 and end block 72. The pressurized air is routed through valve 76 to cavities 82, 84, 86 and 88 to actuate each actuator 46 between extended and retracted positions corresponding to the open and closed positions of valve block 20 shown in FIGS. 4A and 4B, respectively.

When it is desired to actuate each actuator 46 in a first direction illustrated by arrow 90 in FIG. 4A, valve 76 is turned on and pressurized air is supplied through valve 76 and passages 94 and 96 to cavities 82 and 86, respectively. Simultaneously, cavities 84 and 88 are vented to the atmosphere via passages 98 and 100, respectively, and valve 76. This causes each actuator 46 to move to an extended position, corresponding to the open position of valve block 20 illustrated in FIG. 4A. A pair of stops 101 are attached to valve 12 by conventional fasteners such as bolts 103. Stops 101 are used to limit the travel of valve block 20 in the direction of arrow 90 and are positioned so valve block 20 contacts stops 101 before actuators 46 are fully extended to set the travel of valve block 20. In the illustrative embodiment, stops 101 are washers, but other structures can be used as stops for valve block 20. As a further alternative, stops 101 can be eliminated, with the travel of actuators 46 determined by a structure within actuators 46 as described in U.S. patent application Ser. No. 11/263,485, assigned to the assignee of the present invention, and the disclosure of which is herein incorporated by reference in its entirety.

When an operator desires to retract the actuators 46, which operate in parallel with one another, the solenoid valve 76 is turned off, or de-energized. With the solenoid valve 76 in this state, pressurized air is supplied to cavities 84 and 88 via passages 98 and 100, respectively, and cavities 82 and 86 are simultaneously vented to the atmosphere via passages 94 and 96, respectively, and valve 76. This causes forces to be exerted on pistons 48 and 49 in a direction substantially parallel to the direction illustrated by arrow 92. As a result, pistons 48 and 49 and stem 50 translate within body 44 in a direction illustrated by arrow 92 to a retracted position corresponding to the closed position of valve block 20 shown in FIG. 4B.

With reference to FIGS. 3, 4A-4B, and 5, actuator assembly 14 further includes a pair of connecting members 102, with each of the connecting members 102 being associated with one of the actuators 46. As shown in FIG. 3, each connecting member 102 is coupled at a first end 104 to the stem 50 of the corresponding actuator 46. This coupling can be accomplished by any conventional devices and/or methods, such as threading each member 102 onto the corresponding stem 50. Each connecting member 102 is coupled, at an opposite end 106, to valve block 20. In the embodiment shown in FIGS. 2-9, this coupling is accomplished by a pin 108 that protrudes from valve block 20 and extends through an aperture formed in the end 106 of connecting member 102. However, in other embodiments, the connecting members 102 may be otherwise coupled, for example, to the valve block 20.

The actuators 46 act in substantial unison so that they are extended or retracted at the same time. This causes the lateral ends of valve block 20 to slide substantially uniformly relative to the valve body 16, as may be appreciated based on the spatial relationship of connecting members 102 relative to valve block 20.

Valve 12 further includes first and second end blocks 110, 112 that are integral with the valve body 16. First end block 110 terminates in a mount flange 114 and, similarly, second end block 112 terminates in a mount flange 116. Body 44 of actuator assembly 14 is secured to end blocks 110 and 112 by conventional fasteners, such as bolts 118 that extend through apertures 120 formed in flange 114 and similar apertures formed in flange 116, into the body 44 of actuator assembly 14. Accordingly, body 44 of actuator assembly 14 does not move relative to valve 12.

With particular reference to FIG. 5, valve 12 includes an inlet port 122 that is adapted at one end to be secured to the end block 110 and is adapted at the other end to receive pressurized, heated adhesive from a source 124 of the adhesive and conduit 125 interconnecting the source 124 and inlet port 122. A supply passage 126 passes through the inlet port 122, as shown in FIG. 5, through a portion of end block 110 and then extends through valve body 16 in a first direction, through a portion of end block 112 and through another portion of valve body 16 in a second direction, with this flow path indicated by flow arrows 128*a* 128*b*, 128*c*. In other embodiments, the adhesive may take a different path through valve 12.

Figure 2A:
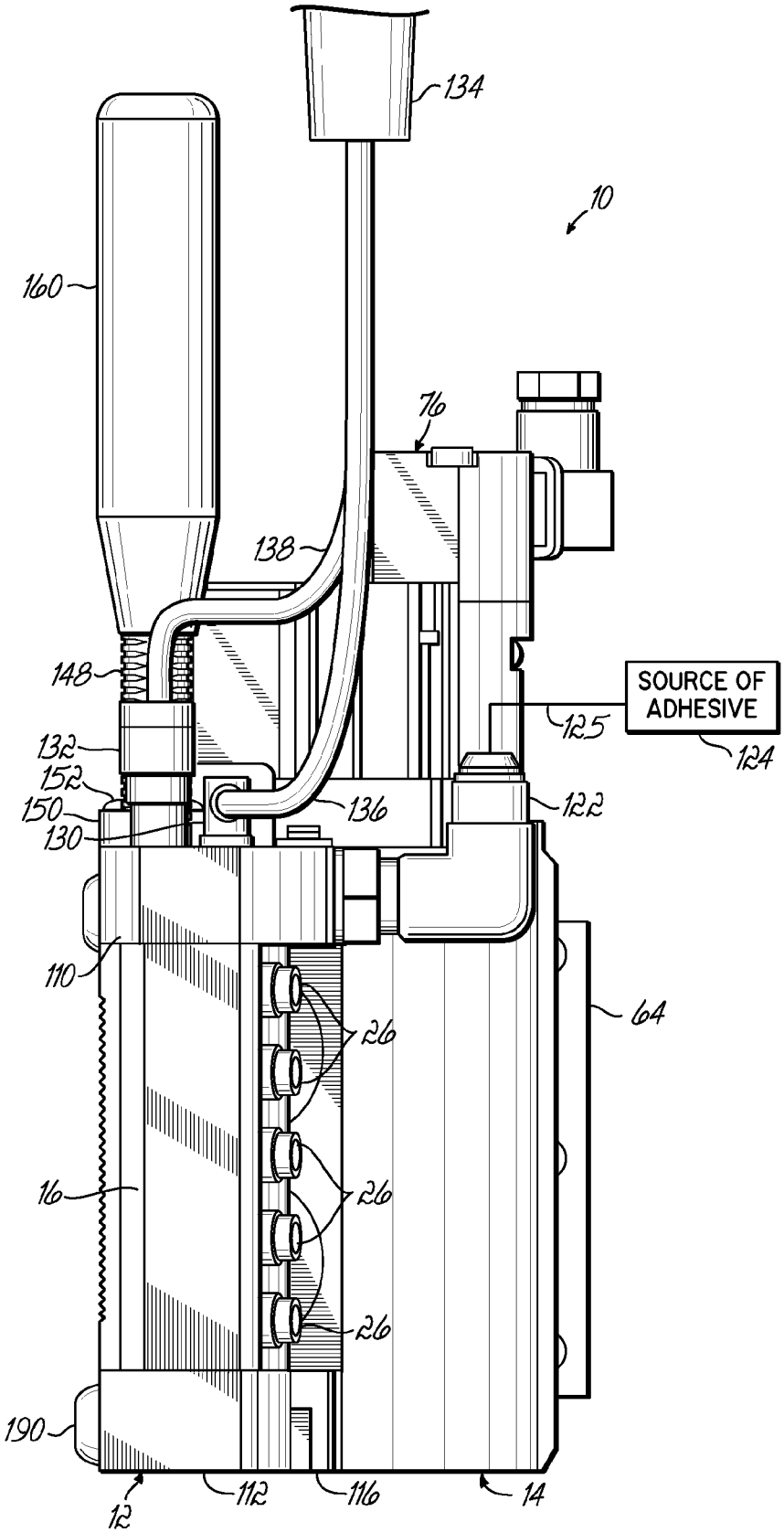
FIG. 2A is a side elevational view of the adhesive dispenser of FIG.2.

With continued reference to FIGS. 3, 4A-4B, and 5, dispenser 10 includes a heating element 130 (FIGS. 4A and 4B) that extends partially through valve body 16 for the purpose of heating valve body 16 and the adhesive within valve body 16. Dispenser 10 also includes a temperature-sensing device 132, which also extends into the valve body 16, for the purpose of measuring the temperature of valve body 16 and which provides an indirect indication of the temperature of the adhesive within valve body 16. Referring again to FIG. 2A, electricity is supplied to the heating element 130 via connector 134 and cable 136, while the output of the temperature-sensing device 132 is routed to a suitable readout (not shown) via cable 138 and connector 134.

The heated adhesive discharges from the supply passage 126 into a first plurality of distribution passages 140 formed in valve body 16. A first end 141 (FIGS. 4A and 4B) of the passages 140 open into the supply passage 126 and a second end 143 (FIGS. 4A and 4B) of the distribution passages 140 open onto the surface 18 of the valve body 16. At least some of the distribution passages 140 are in fluid communication with the supply passage 126, with the number of passages 140 in fluid communication with passage 126 being determined by a position of a dosing rod 142 disposed at least partially within the supply passage 126. This, in turn, determines a width W (FIG. 5) of the adhesive pattern dispensed onto a work piece or substrate such as a surface 144 of a substrate 146 in the form of a board.

With continued reference to FIGS. 3, 4A-4B, and 5, a graduated cylinder 148 is secured to the valve body 16 and extends away from valve body 16. In the illustrative embodiment, the valve 12 includes a mount block 150 that is secured to end block 110 by conventional fasteners such as bolts 152. Also in the illustrative embodiment, the cylinder 148 has an annular flange 154 that is captured in a recess 156 formed in the mount block 150. The graduated cylinder further includes an internal bore 158 that is substantially aligned with a portion of the supply passage 126, as illustrated in FIG. 5.

A handle 160 is threaded onto the graduated cylinder 148 by internal threads formed in the handle and mating external threads formed on an exterior surface of the graduated cylinder, as indicated collectively at 162. As shown in FIG. 5, the dosing rod 142 extends beyond the end of cylinder 148 that is opposite flange 154, and extends through an internal cavity 164 defined by handle 160. One end of the dosing rod 142 is secured within handle 160 by conventional fasteners, such as set screws 166. Accordingly, as handle 160 is rotated, such that it moves relative to the graduated cylinder 148, the dosing rod 142 also rotates with handle 160 and translates within the supply passage 126 to vary the width W of adhesive dispensed by dispenser 10. As may be appreciated with reference to FIG. 5, as the dosing rod 142 translates within supply passage 126, more or less of the distribution passages 140, via proximal ends 141, are in fluid communication with the supply passage 126.

Figure 6:
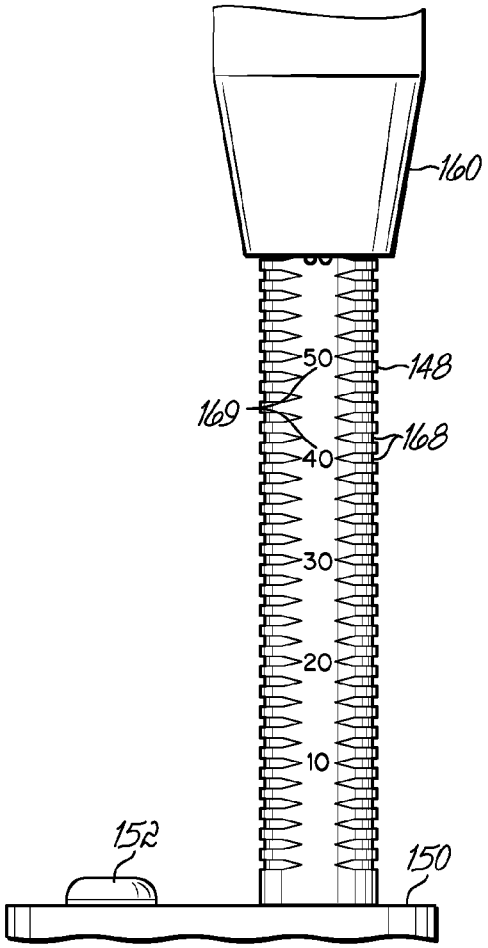
FIG. 6 is an enlarged, fragmentary view further illustrating a graduated cylinder of the adhesive dispenser of FIG. 2.

With continued reference to FIGS. 3, 4A-4B, and 5, and with further reference to FIG. 6, the graduated cylinder 148 includes a plurality of longitudinally spaced grooves 168 that are operatively effective for providing an indication of the width W of the adhesive being dispensed. The graduated cylinder 148 can optionally further include a plurality of indicia 169 on an outer surface of the cylinder 148, with each of the indicia being aligned with one of the grooves 168. In the illustrative embodiment, each of the indicia 169 are Arabic numerals that can correspond to the width W of adhesive being dispensed, as measured in millimeters, for instance.

Figure 8A:
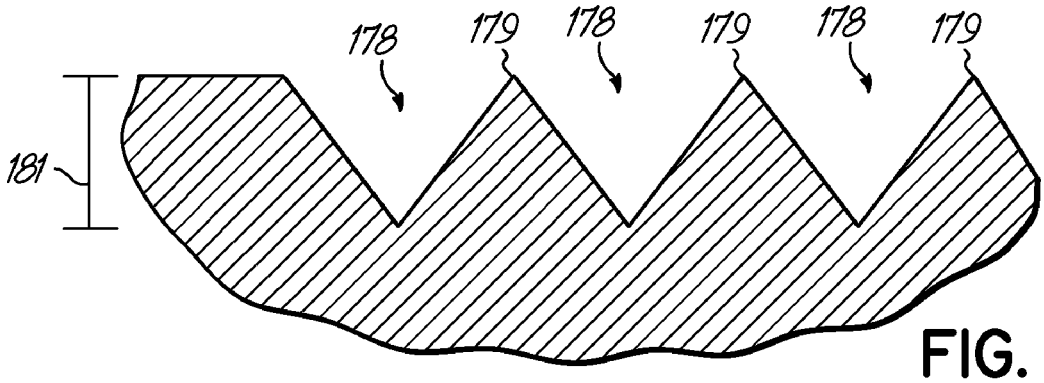
FIG. 8A is a fragmentary cross-sectional view further illustrating the grooves formed in the valve block shown in FIGS. 8C and 8D.
Figure 8B:
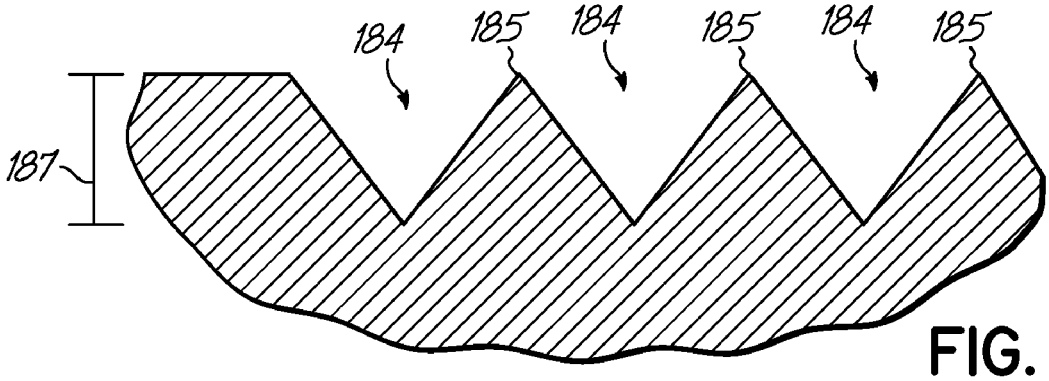
FIG. 8B is a fragmentary cross-sectional view further illustrating the grooves formed in the valve body shown in FIGS. 8C and 8D.
Figure 8C:
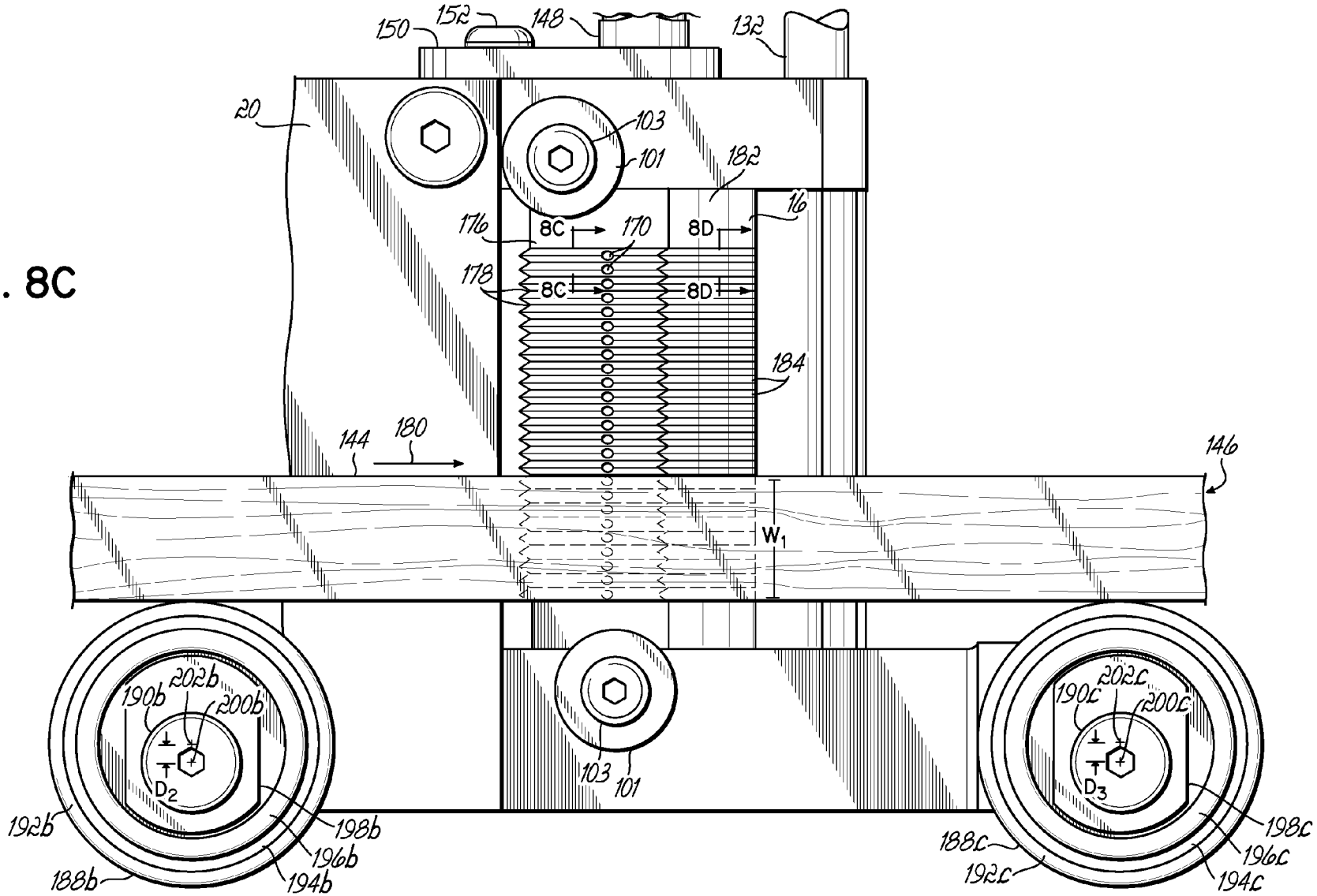
FIG. 8C is a fragmentary, enlarged, front elevation view illustrating a portion of the dispenser shown in FIG. 2, with rollers and a work piece added, and the rollers spaced from grooves of the dispenser by a first distance.
Figure 8D:
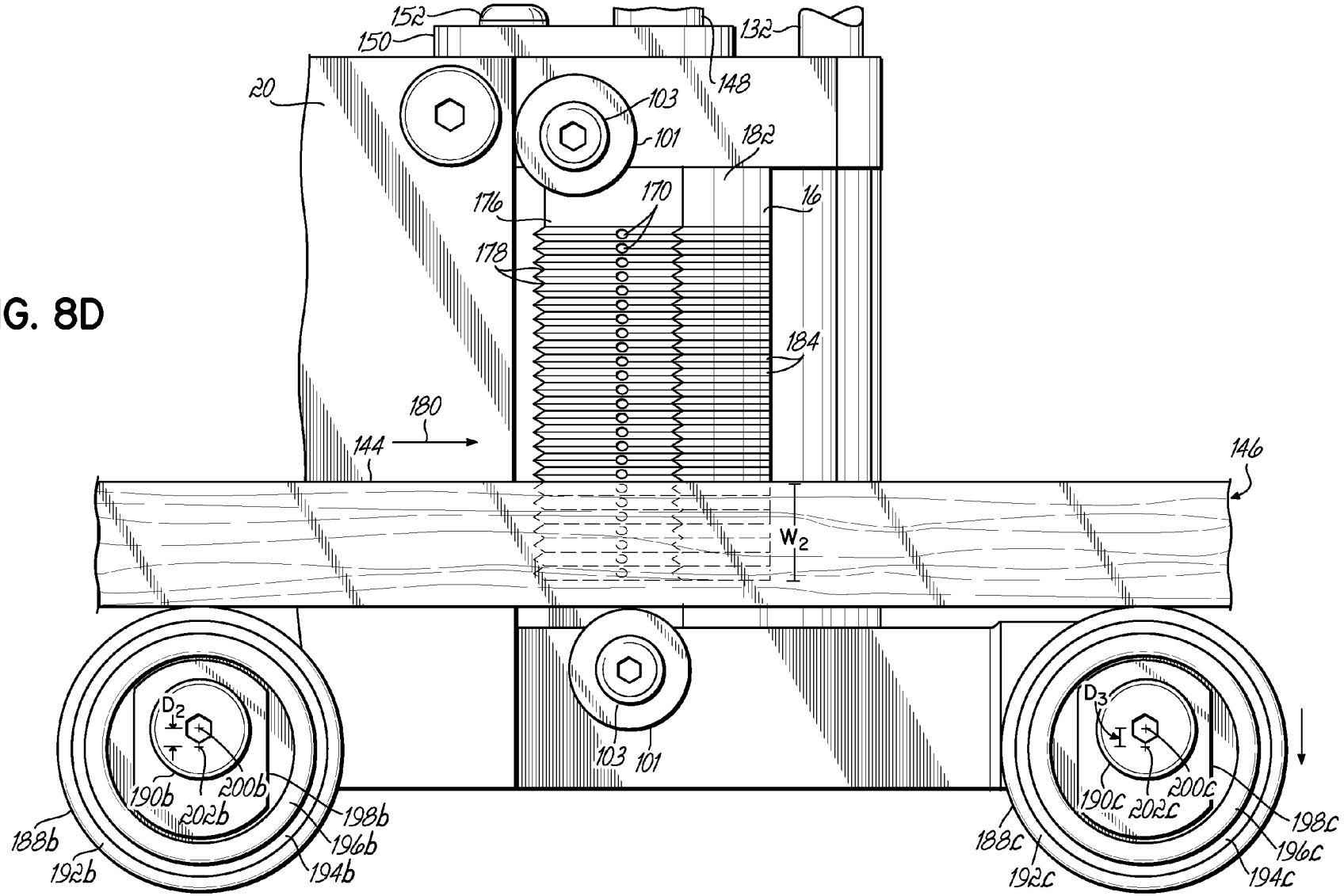
FIG. 8D is a fragmentary, enlarged, front elevation view similar to FIG. 8A, but with the rollers spaced from the grooves by a second distance.

Valve block 20 includes distribution passages 170 extending through valve block 20, as illustrated in FIG. 5. Each of the passages 170 has a first, proximal end 172 (FIGS. 4A and 4B) opening toward the valve body 16, and a second, distal end 174 (FIGS. 4A and 4B) adapted to dispense the heated adhesive onto a substrate, such as surface 144 of work piece 146, which can be a piece of wood, for instance. When each of the actuators 46 is in the extended position, the valve block 20 is in an open position and the first end 172 of each passage 170 is aligned with the distal end 143 of one of the passages 140. The second end 174 of each distribution passage 170 opens onto an outer surface 176 of valve block 20 (FIGS. 8C and 8D). A set of grooves 178 is formed in the outer surface 176 of valve block 20, each extending substantially in a direction corresponding to a direction 180 of movement of the work piece 146. The second ends 174 of the distribution passages 170 are in fluid communication with the grooves 178.

The valve body 16 further includes an outer surface 182 and a set of grooves 184 formed therein, with the grooves 184 extending substantially in a direction corresponding to the direction of movement 180 of the work piece 146. In the illustrative embodiment, the grooves 178 and the grooves 184 have substantially V-shaped cross-sections, as shown in FIGS. 8A and 8B, respectively. Alternatively, grooves 178 and 184 can have other suitably chosen shapes.

Figure 7:
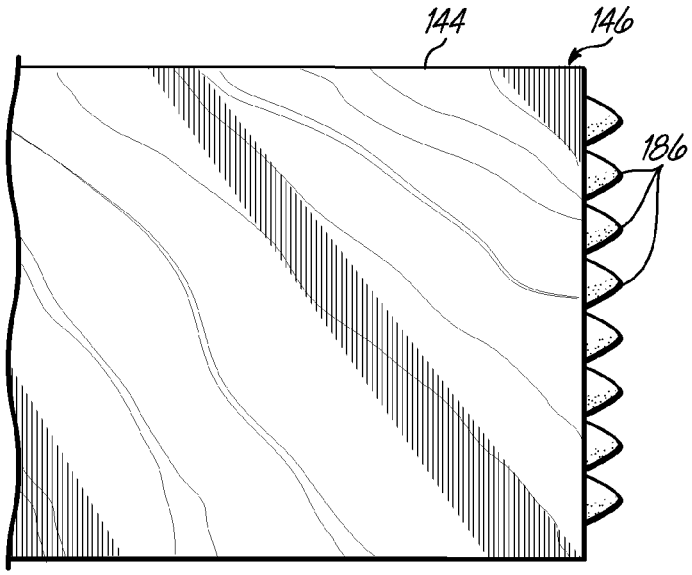
FIG. 7 is a side elevational view illustrating a plurality of beads of adhesive disposed on a surface of a substrate or work piece.

When the valve block 20 is in an open position, the heated adhesive flows through the supply passage 126 and then through those passages of the first distribution passages 140 that are not blocked by dosing rod 142. The adhesive then flows through aligned ones of the distribution passages 170, opening onto the grooves 178 formed in the valve block 20. The adhesive is dispensed via grooves 178 and 184 onto the surface 144 of the work piece 146 in beads 186 that can initially have a substantially triangular shape, as shown in FIG. 7. The outermost ridges 179 of grooves 178 and the outermost ridges 185 of grooves 184 may be in substantially firm contacting engagement with surface 144 of work piece 146 during application of adhesive onto surface 144 to ensure the desired control of the pattern of applied adhesive.

With reference to FIGS. 8A and 8B, each groove 178 has a depth 181 (FIG. 8A) and each groove 184 has a depth 187 (FIG. 8B). The magnitude of depth 181 of grooves 178 and the magnitude of depth 187 of grooves 184 are predetermined to control the volume of adhesive dispensed for a particular application, i.e., for a particular range of adhesive viscosity and a particular range of substrate density. Accordingly, the predetermined magnitudes of depths 181 and 187 of grooves 178 and 184, respectively, also control the ultimate film thickness of adhesive for a particular application, that exists between a substrate or work piece, such as work piece 146, and an edge band material (not shown) secured to the work piece 146 with the adhesive. The magnitudes of the depths 181 of grooves 178 and depths 187 of grooves 184 can be varied, from one application to another, to compensate for different adhesive viscosities and substrate densities to adjust the volume of adhesive applied as required. This can be accomplished by having multiple matched sets of valve body 16 and valve block 20 that are uniquely identified, such as by part number, with the various sets having different magnitudes of the depth 181 of grooves 178 and depth 187 of grooves 184 for use in different applications.

When the valve block 20 is in a closed position, the distribution passages 170 in valve block 20 are not aligned with the distribution passages 140 in valve body 16 as can be appreciated with reference to FIG. 4B. Accordingly, passages 170 are not in fluid communication with passages 140. With valve block 20 closed, adhesive from the supply passage 126 is stopped at the interface of surface 42 of valve block 20 and passages 140. This is considered the valving point. The volume of adhesive downstream of the valving point is essentially the volume of the distribution passages 170, which is relatively low. Accordingly, dispenser 10 provides a relatively clean cutoff of the adhesive.

Figure 9:
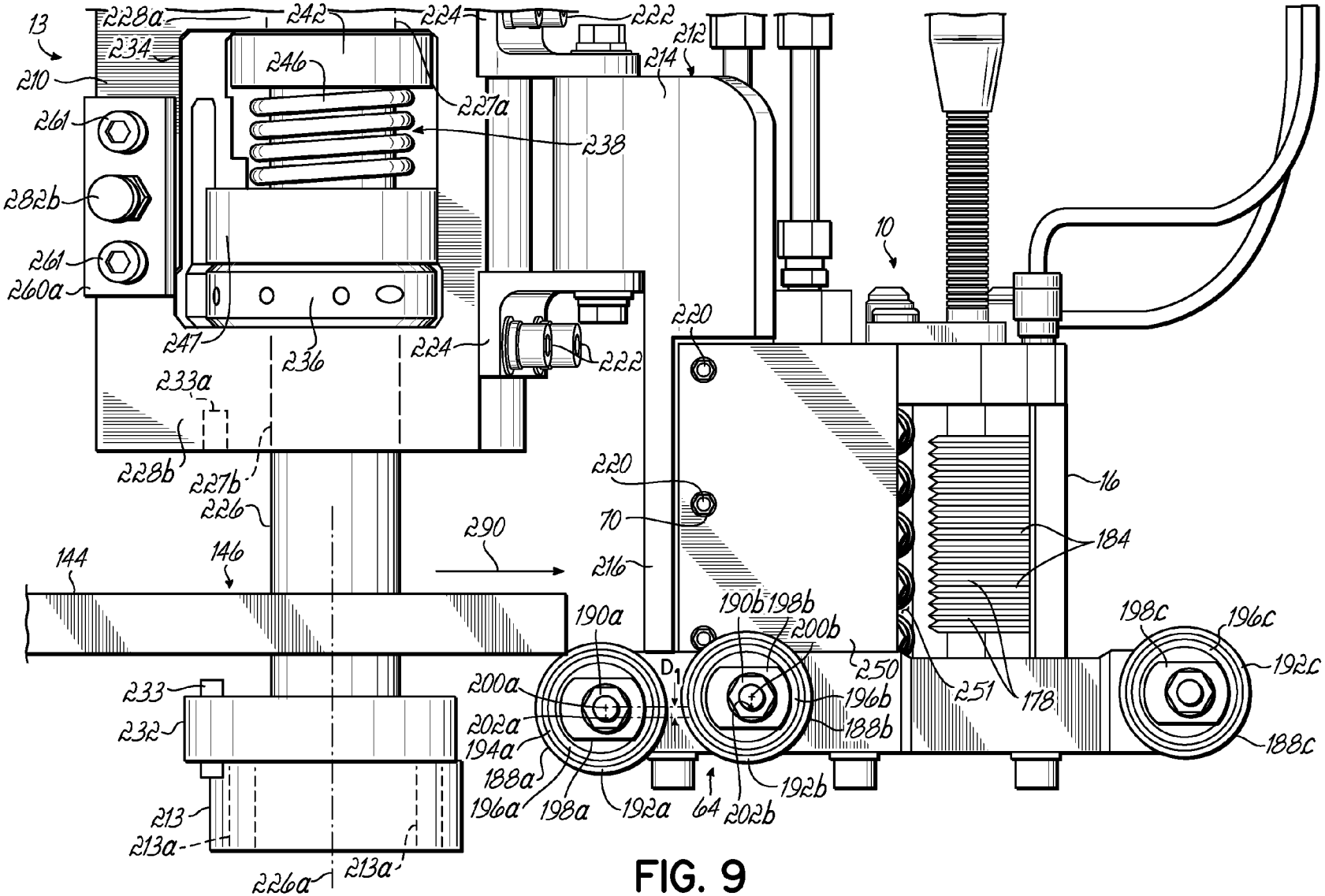
FIG. 9 is a side elevational view of the system of FIG. 1 showing a step in dispensing of adhesive onto the substrate of FIG. 1A.

With reference to FIGS. 8C, 8D, and 9, the adhesive dispenser 10 includes one or more rollers to aid in the application of adhesive to a work piece. In this illustrative embodiment, adhesive dispenser 10 includes three rollers 188*a*, 188*b*, 188*c* (FIG. 9) rotatably mounted to the valve 12 and which guide the work piece 146 as it moves by grooves 178 and 184 for application of the adhesive onto the surface 144 of the work piece 146. The rollers 188*a*, 188*b*, 188*c* are rotatably mounted to the end block 112 of valve body 16, respectively, via bolts 190*a*, 190*b*, 190*c*. Each of rollers 188*a*, 188*b*, 188*c* respectively includes an outer race 192*a*, 192*b*, 192*c*, a ring 194*a*, 194*b*, 194*c* of bearings (individual bearings not shown) and an inner race 196*a*, 196*b*, 196*c*.

The outer peripheral surface of each outer race 192*a*, 192*b*, 192*c* contacts work piece 146 as it passes by dispenser 10 and therefore positions work piece 146 relative to grooves 178 and 184. The respective positions of each outer race 192*a*, 192*b*, 192*c* relative to grooves 178 and 184, in conjunction within the position of the dosing rod 142 within supply passage 126, establishes the width of the adhesive pattern being dispensed.

Cams 198*a*, 198*b*, 198*c* are also secured to valve 12 respectively by bolts 190*a*, 190*b*, 190*c*. Each bolt 190*a*, 190*b*, 190*c* has a respective center 200*a*, 200*b*, 200*c*, as shown in FIG. 8C. Each cam 198*a*, 198*b*, 198*c* has a bore formed therethrough, with a respective center 202*a*, 202*b*, 202*c* that is offset relative to each respective center 200*a*, 200*b*, 200*c* of bolt 190*a*, 190*b*, 190*c* by respective distances $D_1$, $D_2$, $D_3$. This offset relationship allows the position of each outer race 192*a*, 192*b*, 192*c* to be varied as the corresponding cam 198*a*, 198*b*, 198*c* is clocked or rotated respectively about bolt 190*a*, 190*b*, 190*c*. This is enabled by engagement of the respective arcuate surfaces of cams 198*a*, 198*b*, 198*c* with respective inner races 196*a*, 196*b*, 196*c* of respective rollers 188*a*, 188*b*, 188*c*.

FIG. 8C illustrates rollers 188*b*, 188*c* in a first position, which corresponds to the smallest distance from grooves 178 and 184 and results in a width $W_1$ of the pattern of adhesive being dispensed. FIG. 8D illustrates rollers 188*b*, 188*c* in a second position achieved by rotating the respective cams about 180 degrees relative to the position shown in FIG. 8C. In this second position, the distance between rollers 188*b*, 188*c* and grooves 178 and 184 is the greatest and results in a width $W_2$ of the pattern of adhesive being dispensed. It is contemplated that one or more of the cams 198*a*, 198*b*, 198*c* of respective rollers 188*a*, 188*b*, 188*c* may be rotated by an amount that is different from an amount by which another of the cams 198*a*, 198*b*, 198*c* is rotated.

The first roller 188*a* is positioned at a height or vertical position relatively lower than a height or respective heights of the second and third rollers 188*b*, 188*c*, as described in further detail below. While the above description describes a specific embodiment of an adhesive dispenser 10 as discussed and depicted, it is contemplated that other types of adhesive dispensers may be alternatively used to define the edge banding system 5. As noted above, the edge banding system 5 includes an adhesive dispenser 10 mounted to a frame 11 via a mounting bracket 13, the description of which follows.

With reference to FIGS. 1 and 9-14, mounting bracket 13 includes a main body 210 coupled to the frame 11 (FIG. 1) and a connecting structure 212 coupling the main body 210 to the adhesive dispenser 10. As explained in further detail below, the mounting bracket 13 permits, upon contact of adhesive dispenser 10 with work piece 146, the adhesive dispenser 10 to move vertically (i.e., in a generally vertical plane) relative to a base 213 of the mounting bracket 13. The mounting bracket 13 moreover permits, upon contact of adhesive dispenser with work piece 146, adhesive dispenser 10 to rotate, in a generally horizontal plane, relative to the base 213.

In this exemplary embodiment, the connecting structure 212 is generally L-shaped and has first and second ends 214, 216 respectively coupled to the main body 210 and the protruding portion 68 (FIG. 3) of end block 64 of the dispenser 10. More particularly, the second end 216 is coupled to the protruding portion 68 via engagement of fasteners such as bolts 220 extending through holes 70 of protruding portion 68. The main body 210 is coupled to the first end 214 of the connecting structure 212 via bolts 222 extending through a pair of plates 224 at the first end 214.

The main body 210 is coupled to the frame 11 (FIG. 1) via a support post 226 defining a portion of the mounting bracket 13 and which includes base 213. The mounting bracket 13 supports the weight of the adhesive dispenser 10 in a cantilever fashion suspended by connecting structure 212. The base 213 is suitably fixed to the frame 11 of the edge banding system 5. Coupling between the base 213 and frame 11 includes one or more jacking screws 213*a* (shown in phantom) that enable tilting of the support post 226 relative to the frame 11. The jacking screws 213*a* facilitate, for example, coupling of the support post 226 to a not-perfectly horizontal or flat coupling surface of the frame 11. Alternatively, the frame 230 may be coupled with support 226 without the assistance of jacking screws or the like.

A split positioning block 232 is slidably disposed over support post 226 and between base 213 and main body 210. Split positioning block 232 includes a dowel pin 233 that permits locking the angular position of mounting bracket 13 and adhesive dispenser 10 relative to support 26. More specifically, dowel pin 233 is received within a hole 233*a* extending through main body 210 such that rotation of main body 210 relative to split positioning block 232 is restricted. Once dowel pin 233 is inserted into hole 233*a*, the positioning block 232 is frictionally coupled to support post 226, in this embodiment, by turning one or more handles 233*b* (only one shown in FIG. 13) configured to drive one or more bolts or screws 233c that provide coupling between two portions 232*a*, 232*b* defining split positioning block 232.

Split positioning block 232 permits repeatability in the angular positioning of mounting bracket 13 and adhesive dispenser 10. More specifically, mounting bracket 13 and adhesive dispenser 10 may be separated, for example, for a maintenance operation, from support post 226 while leaving the split positioning block 232 coupled to support post 226. Upon completion of the maintenance operation, the mounting bracket 13 and adhesive dispenser 10 may be re-coupled to support post 226 in the single orientation provided by dowel pin 233, with dowel pin 233 being received within the hole 233*a* in main body 210 of mounting bracket 13.

With particular reference to FIG. 9, the main body 210 is a rectangular structure having a rectangular opening 234, which effectively lessens the weight of the main body 210. The main body 210 is slidably coupled to the support post 226 by receiving the support post 226 through coaxial apertures 227*a*, 227*b* respectively disposed in upper and lower horizontally oriented frame segments 228*a*, 228*b* of the main body 210.

A body adjuster 236 is fixed to the support post 226. By abutting body adjuster 236 against the lower frame segment 228*b*, the vertical position of the main body 210 is restricted. More particularly, the body adjuster 236 restricts upward movement of the main body 210 relative to the support post 226. In this regard, the vertical position of the main body 210 relative to the support post 226 is adjustable, such that an upper vertical position limit of the adhesive dispenser 10 is similarly adjustable.

A compression assembly 238 limits downward movement of the main body 210 relative to the support post 226. More particularly, the compression assembly 238 engages the upper frame segment 228*a* to limit such movement. The compression assembly includes a compression spring 246 disposed about the support post 226, as well as a ring 242 abutting against the upper frame segment 228*a*. In operation, to be explained in further detail below, the main body 210 moves downward relative to the support post 226 by engaging the ring 242. More particularly, the upper frame segment 228*a* engages the ring 242, which in turn compresses the compression spring 246 to thereby move the main body 210 downward. The compression spring 246 abuts against an upper surface of a side load locking collar 247 positioned between the body adjuster 236 and the compression spring 246 and which is tightly coupled to support post 226 such that its vertical movement relative to support post 226 is restricted.

The compression spring 246 supports the main body 210 and the entire weight of the adhesive dispenser 10. Moreover, vertical movement of the adhesive dispenser 10 relative to support post 226 and, more particularly, to base 213, is limited by the range of compression of the compression spring 246.

Figure 13:
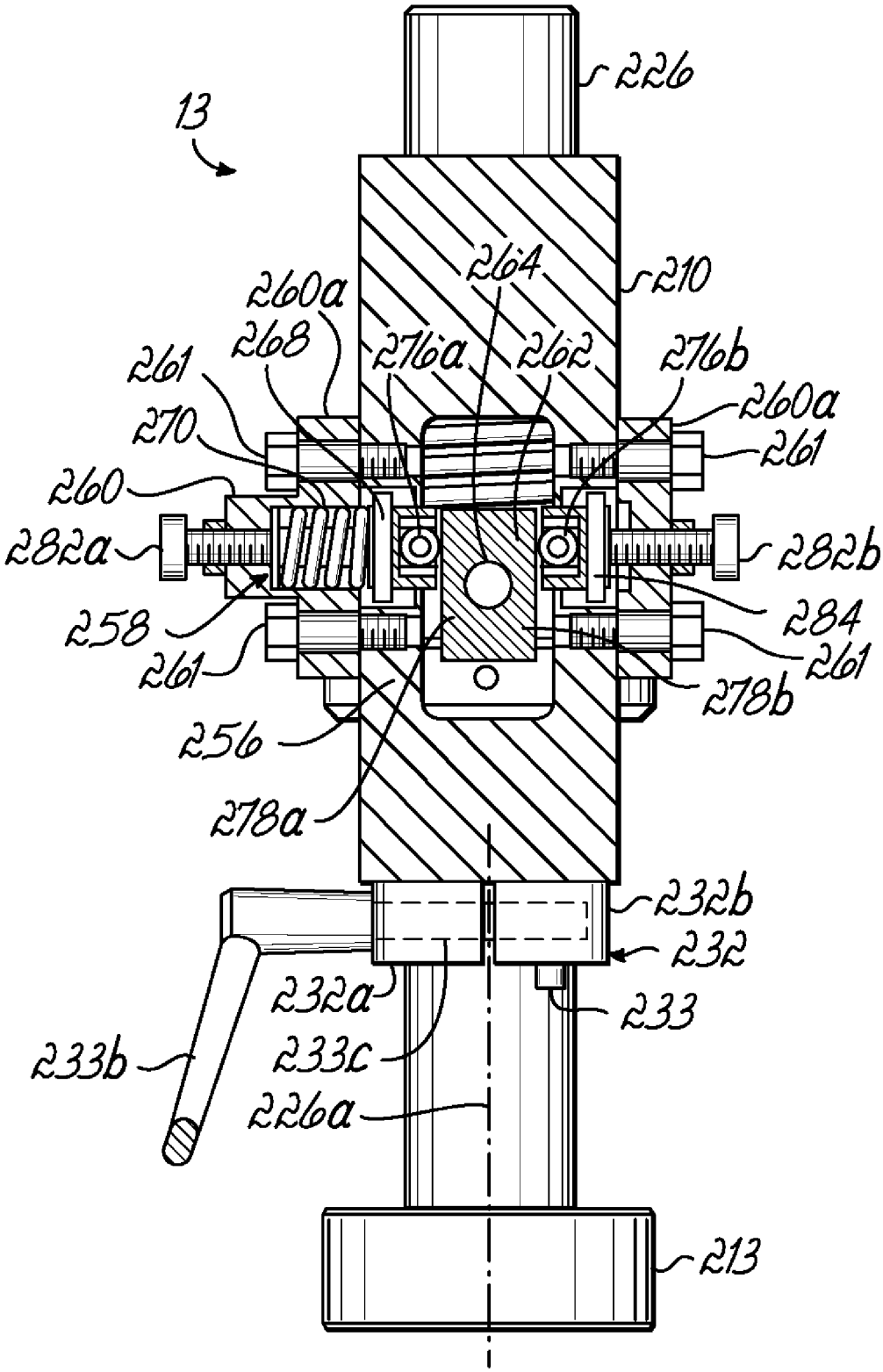
FIG. 13 is a partial cross-sectional view taken generally along line 13-13 of FIG. 1.
Figure 14:
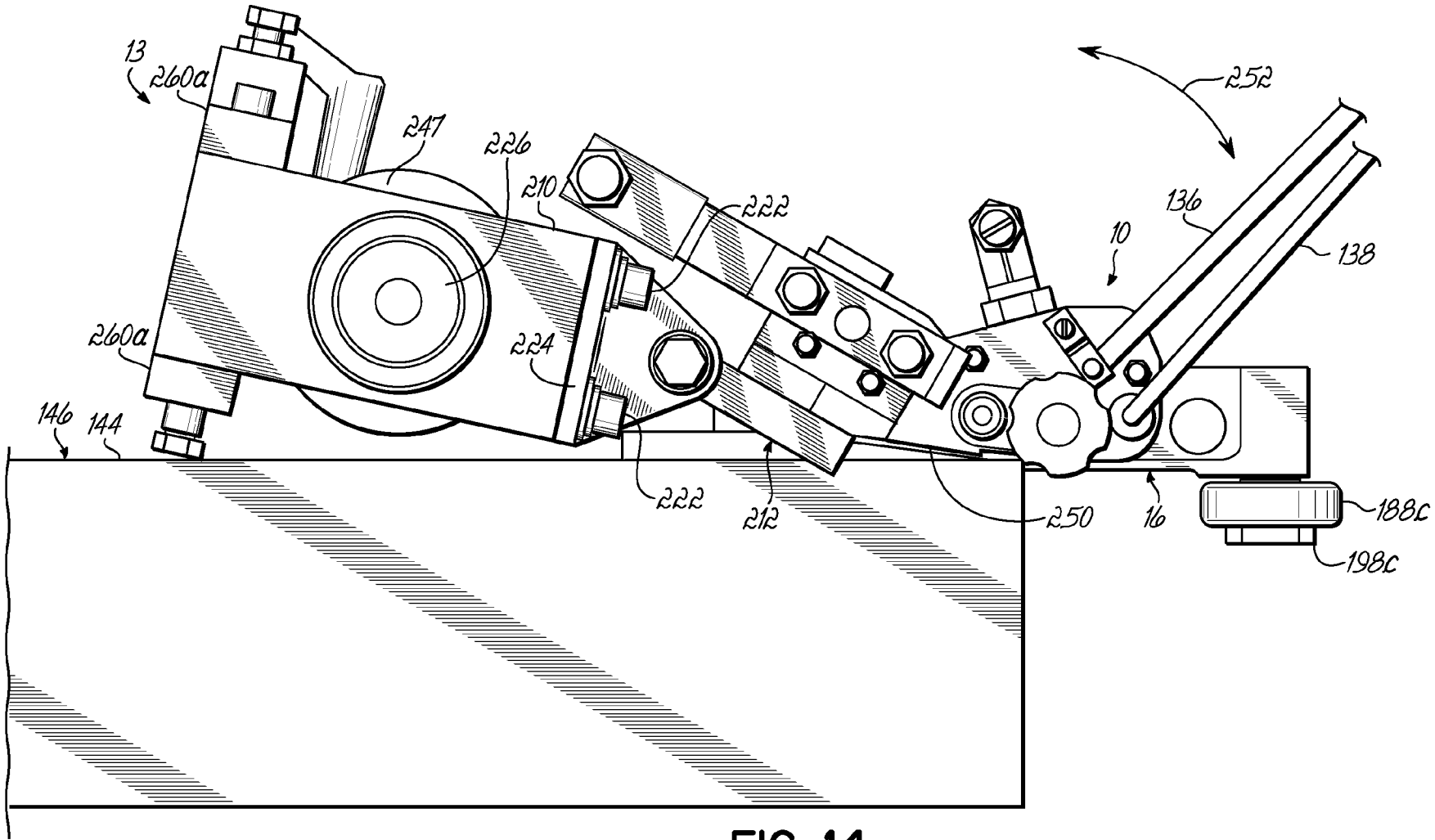
FIG. 14 is a top view of the system and work piece of FIG. 1A.

With particular reference to FIGS. 13-14, and as noted above, the mounting bracket 13 is configured to facilitate rotational motion of the adhesive dispenser 10 relative to the base 213. More particularly, this rotational motion is generally oriented in a plane transverse to an axis 226*a* of support post 226. In this exemplary embodiment, this plane is, moreover, a generally horizontal plane. In this regard, rotational movement of the adhesive dispenser 10 is effected by contact made by the work piece 146 with a skid plate 250 disposed on a face 251 (FIG. 9) of the valve body 16.

Contact between the surface 144 of work piece 146 and skid plate 250 pushes the adhesive dispenser 10 in a way such that grooves 178, 184 (FIG. 9) are forced into parallel alignment with surface 144. Rotational motion of the adhesive dispenser 10, accordingly, follows the general direction of arrow 252 and includes pivoting about support post 226. More particularly, a force applied by the work piece 146 against the skid plate 250 rotates the adhesive dispenser 10 and main body 210, which is coupled to dispenser 10, about support rod 226.

In this regard, and with continued reference to FIGS. 13-14, rotational motion of the main body 210 causes a side frame segment 256 of main body 210 to engage a biasing element of the mounting bracket 13. More specifically, a spring-loaded side load assembly 258, partially disposed within a housing 260 of side frame segment 256, engages a side load tab 262 fixed relative to support post 226. Housing 260 is coupled to main body 210 through plates 260*a* and bolts 261. The side load tab 262 of this illustrative embodiment has a generally rectangular shape and is suitably attached, for example by one or more fasteners such as bolts 264, to the side load locking collar 247. The side load tab 262 is coupled to the side load locking collar 247 such that side load tab 262 is restricted from vertical and rotational movement relative to support post 226.

As noted above, the spring loaded side load assembly 258 engages side load tab 262 upon rotation of main body 210. To this end, rotational motion of the main body 210 pushes an exposed portion 268 of side load assembly 258 against a side load spring 270 of assembly 258 positioned within housing 260, thereby permitting rotation of the adhesive dispenser 10 and main body 210 relative to the side load tab 262 and support post 226. When the force exerted by the work piece 146 against skid plate 250 ceases, the side load spring 270 pushes the exposed portion 268 away from housing 260 and toward side load tab 262. This action by side load spring 270 brings main body 210 and dispenser 10 to the unloaded orientation corresponding to an orientation in which the work piece 146 is not in engaging contact with skid plate 250. Accordingly, adhesive dispenser 10 is spring-biased toward the work piece 146.

With continued particular reference to FIGS. 13-14, a pair of rollers 276*a*, 276*b* contact confronting surfaces 278*a*, 278*b* of side load tab 262 to facilitate vertical movement of the main body 210. More particularly, vertical movement of the main body 210 causes the rollers 276*a*, 276*b* to roll against surfaces 278*a*, 278*b*, thereby facilitating a relatively smooth travel of main body 210 relative to the side load tab 262. The first roller 276*a* is positioned between the exposed portion 268 of side load assembly 258 and confronting surface 278*a* and is connected to a first adjustment screw 282*a* controlling tension of the side load spring 270. The second roller 276*b* is positioned between a distal end of a second adjustment screw 282*b* and confronting surface 278*b*. The second adjustment screw 282*b* controls a lateral fixed position of an exposed portion 284 coupled to second roller 276*b*.

Processing of work piece 146 through edge banding system 5 is best appreciated with reference to the sequence of events depicted in FIGS. 9-12. Accordingly, and with particular reference to FIG. 9, work piece 146 is shown prior to engaging the first roller 188*a* and further moving toward adhesive dispenser 10, generally in the direction of arrow 290. In this view, the vertical position of the adhesive dispenser 10 and, more particularly, the vertical position of the main body 210, is such that no gap exists between the lower frame segment 228*b* and body adjuster 236. Accordingly, the depicted vertical position and angular orientation of the adhesive dispenser 10 jointly define a relative reference position of dispenser 10 relative to the support post 226 and base 213.

Figure 10:
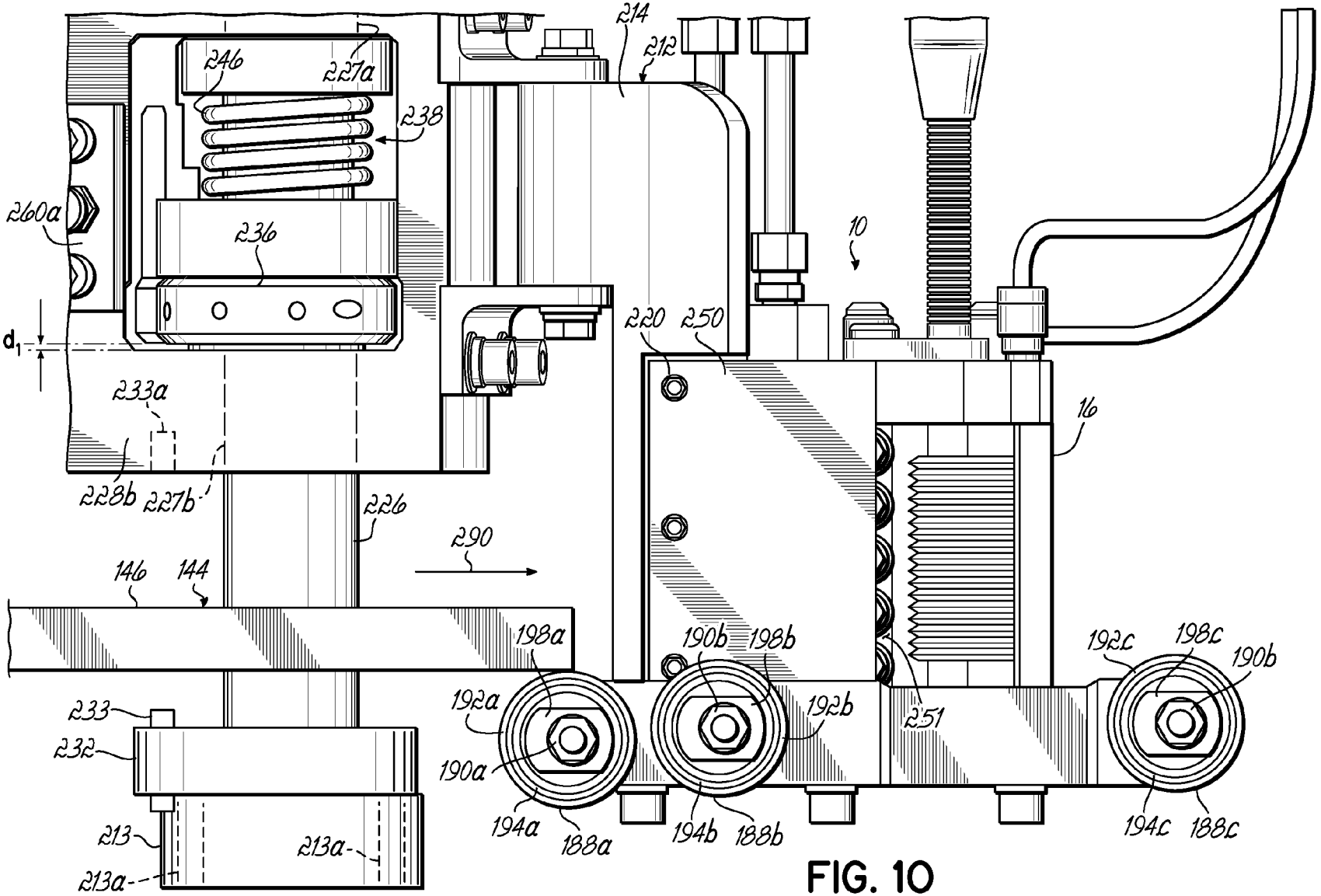
FIG. 10 is a view similar to FIG. 9, showing another step in dispensing of adhesive onto the substrate of FIG. 1A.

With particular reference to FIG. 10, the work piece 146 is shown having engaged the first roller 188*a*, more particularly riding over outer race 192*a*. In this regard, a portion of the weight of work piece 146 supported by roller 188*a* pushes the adhesive dispenser 10 downward, resulting in deflection of the compression spring 246. This deflection, in turn, defines a first gap "$d_1$" between the lower frame segment 228*b* and body adjuster 236.

Figure 11:
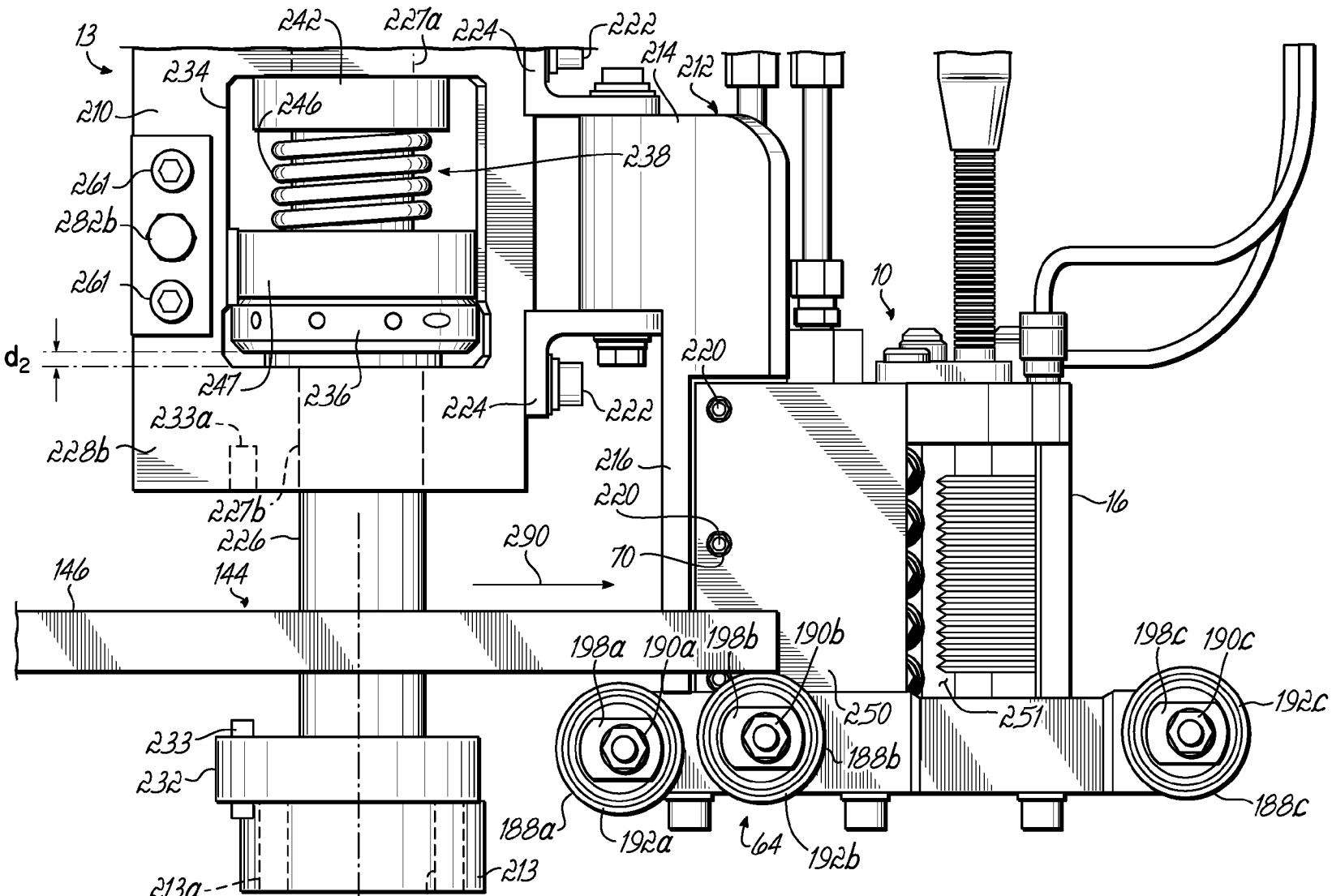
FIG. 11 is a view similar to FIGS. 9-10, showing yet another step in dispensing of adhesive onto the work piece of FIG. 1A.

With particular reference to FIG. 11, the work piece 146 is shown having engaged second roller 188*b*, riding over outer race 192*b*. Movement of work piece 146 in the direction of arrow 290 causes a larger portion of the weight of the work piece 146 to be supported by roller 188*b* than was supported by roller 188*a* in FIG. 10. This fact, and the relatively higher vertical position of second roller 188*b* relative to first roller 188*a*, accordingly, cause main body 210 to move further downward, by compressing compression spring 246 further, and thereby defining a gap "$d_2$" between the lower frame segment 228*b*and body adjuster 236. The surface 144 of work piece 146 contacts skid plate 250, which causes rotational movement of the adhesive dispenser 10 relative to support post 226 and base 213, thereby bringing surface 144 into parallel alignment with grooves 178, 184, as explained above.

Figure 12:
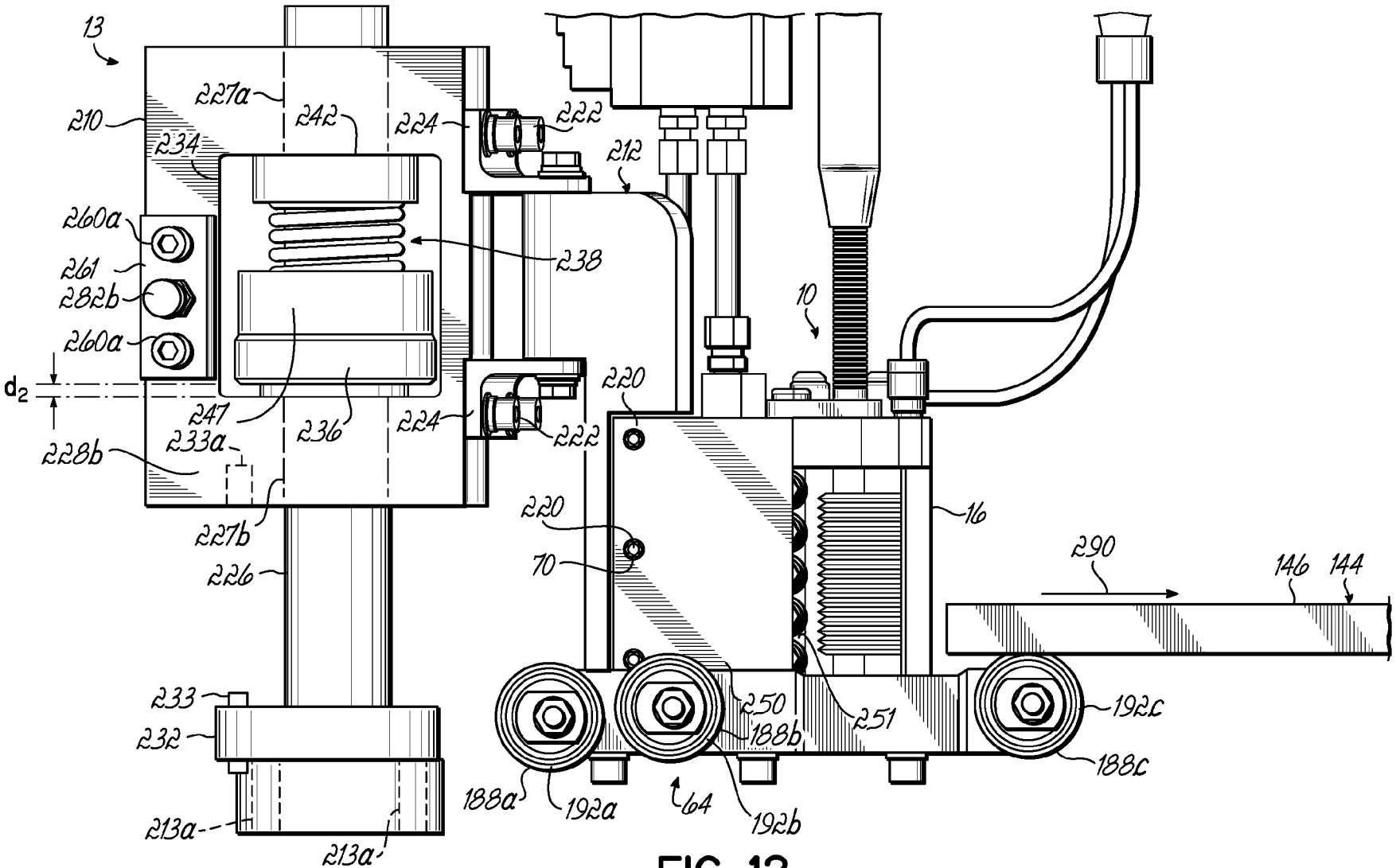
FIG. 12 is a view similar to FIGS. 9-11, showing yet another step in dispensing of adhesive onto the work piece of FIG. 1A.

With particular reference to FIG. 12, the work piece 146 is shown having disengaged from the first and second rollers 188*a*, 188*b* and being only supported by the third roller 188*c*, which is positioned downstream from grooves 178, 184. In the step shown, the portion of the weight of the work piece 146 that is supported by third roller 188*c* maintains the gap "$d_2$" between the lower frame segment 228*b* and body adjuster 236. The vertical position of the third roller 188*c* relative to the second roller 188*b* similarly cooperates to maintain the gap "$d_2$." In this specific embodiment, the vertical positions of the second and third rollers 188*b*, 188*c* are similar. Persons of ordinary skill in the art, however, will readily appreciate that these relative vertical positions may be alternatively different from one another, so long as they enable dispensing of adhesive from grooves 178, 184 within a target area on surface 144 (FIG. 14). Accordingly, the relative vertical positioning as well as rotation of the respective cams 198*b*, 198*c* of the second and third rollers 188*b*, 188*c* cooperate such that adhesive is applied onto a target area on surface 144 along the entire length of the work piece 146.

Referring again to FIGS. 9-13, the vertical movement of the adhesive dispenser 10, enabled by mounting bracket 13, permits the handling of warped work pieces. In particular, a warped work piece will ride over the outer races 192*a*, 192*b*, 192*c* such that the vertical position of the adhesive dispenser 10 will adjust accordingly. For example, and without limitation, a warped work piece (not shown) may have a concave segment on its bottom surface positioned between first and second generally rectilinear segments. Engagement of the concave segment by a roller 188*a*, 188*b*, 188*c* will cause the adhesive dispenser 10 to first move upward relative to the vertical position corresponding to engagement of the first rectilinear segment. Subsequently, the adhesive dispenser will be forced to move downward prior to engaging the second rectilinear segment.

The rotational movement of adhesive dispenser 10, facilitated by mounting bracket 13, similarly permits handling of work pieces having an irregular edge surface onto which adhesive is applied. In particular, a work piece having such an irregular edge surface will cause different levels of engagement with skid plate 250. These varying levels of engagement cooperate with the spring force exerted by side load spring 270 against exposed portion 268 (FIG. 13) to maintain the grooves 178, 184 at a generally fixed distance from the irregular edge surface.

While the invention has been illustrated by the description of one or more embodiments thereof, and while the embodiments have been described in considerable detail, they are not intended to restrict or in any way limit the scope of the appended claims to such detail. The various features described herein may be utilized alone or in any combination. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. An apparatus for use with an adhesive dispenser configured to apply an adhesive to an edge of a moving substrate, the apparatus comprising:

a support post; and a main body configured to support the adhesive dispenser and coupled to said support post, said main body configured to deflect the adhesive dispenser relative to the support post in a first direction and a second direction transverse to the first direction upon contact of the moving substrate with the adhesive dispenser.

2. The apparatus of claim 1, wherein said main body is positioned to deflect the adhesive dispenser relative to the support post in a generally horizontal plane and in a generally vertical plane upon contact of the moving substrate with the adhesive dispenser.

3. The apparatus of claim 1, further comprising:

at least one biasing member operatively coupled to said support post for urging the adhesive dispenser toward the moving substrate.

4. The apparatus of claim 3, wherein said at least one biasing member is positioned to oppose movement of said adhesive dispenser in the first direction or the second direction.

5. The apparatus of claim 3, wherein said at least one biasing member is a compression spring.

6. The apparatus of claim 1, further comprising:

a plate configured for coupling with the adhesive dispenser, said plate positioned to cooperate with said main body to move the edge of the moving substrate into alignment with an output of the adhesive dispenser.

7. The apparatus of claim 1, wherein said main body has a first end coupled to said support post and a second end for coupling to the adhesive dispenser, said main body configured to support the adhesive dispenser in cantilever fashion.

8. The apparatus of claim 1, further comprising:

a first roller configured to support the moving substrate, said first roller positioned downstream of an output of the adhesive dispenser along a direction of travel of the moving substrate.

9. The apparatus of claim 8, wherein said first roller is coupled to the adhesive dispenser.

10. The apparatus of claim 8, further comprising:

a second roller configured to support the moving substrate, said second roller positioned upstream of the output of the adhesive dispenser along a direction of travel of the moving substrate.

11. The apparatus of claim 8, further comprising:

a plurality of rollers coupled to said main body, said plurality of rollers rotatable along said support post for providing vertical movement of said main body relative to said support post.

12. The apparatus of claim 1, further comprising:

a base coupling said support post to a frame of reference, said main body configured to permit rotational movement of the adhesive dispenser relative to said base.

13. An apparatus for use with an adhesive dispenser for applying adhesive to an edge of a moving substrate, the apparatus comprising:

a support post; and a main body configured to support the adhesive dispenser and coupled to said support post, said main body configured to move the adhesive dispenser relative to the support post in a generally horizontal plane and in a generally vertical plane upon contact of the moving substrate with the adhesive dispenser;

a pair of biasing members coupled to said main body for opposing respective movement of the adhesive dispenser in the horizontal and vertical planes; and a roller positioned downstream of an output of the adhesive dispenser along a direction of travel of the moving substrate and configured to support the moving substrate.

14. An edge banding system for applying adhesive onto an edge of a moving substrate, the edge banding system comprising:

an adhesive dispenser including an output surface adapted to dispense the adhesive onto the moving substrate; and a mounting system coupled to said adhesive dispenser, said mounting system having a support post and a main body for supporting said adhesive dispenser and coupled to said support post, said main body configured to deflect said adhesive dispenser relative to the support post in a first direction and a second direction transverse to the first direction upon contact of the moving substrate with the adhesive dispenser.

15. The edge banding system of claim 14, wherein said output surface is adjustable to define a dimension of the adhesive applied onto the moving substrate.

16. The edge banding system of claim 14, wherein said output surface includes a plurality of grooves defining beads of the adhesive applied onto the moving substrate.

* * * * *